US010702438B1

(12) United States Patent
Kring

(10) Patent No.: US 10,702,438 B1
(45) Date of Patent: Jul. 7, 2020

(54) KNEE RESTRAINT SYSTEM

(71) Applicant: Bob Kring, Longwood, FL (US)

(72) Inventor: Bob Kring, Longwood, FL (US)

( * ) Notice: Subject to any disclaimer, the term of this patent is extended or adjusted under 35 U.S.C. 154(b) by 29 days.

(21) Appl. No.: 15/394,381

(22) Filed: Dec. 29, 2016

Related U.S. Application Data

(60) Provisional application No. 62/272,570, filed on Dec. 29, 2015.

(51) Int. Cl.
*A61G 13/12* (2006.01)
*A61G 13/10* (2006.01)
*A61G 13/00* (2006.01)

(52) U.S. Cl.
CPC ..... *A61G 13/1245* (2013.01); *A61G 13/0063* (2016.11); *A61G 13/101* (2013.01)

(58) Field of Classification Search
CPC ..... A61G 13/1245; A61G 13/0063; A61G 13/101
See application file for complete search history.

(56) References Cited

U.S. PATENT DOCUMENTS 1,376,280 A * 4/1921 James
3,027,895 A * 4/1962 Williams ..... A61F 5/3761 128/878
4,299,213 A * 11/1981 Violet ..... A61G 13/12 128/882
4,526,165 A * 7/1985 Mielnik, Jr. ..... A61F 5/3761 128/882
4,545,573 A 10/1985 Murphy
4,607,885 A 8/1986 del Fierro
4,766,892 A * 8/1988 Kreitman ..... A61G 13/12 5/623
5,377,510 A 1/1995 Smith
5,645,079 A * 7/1997 Zahiri ..... A61F 5/3769 128/882
7,340,926 B2 3/2008 Kim et al.
8,689,793 B2 * 4/2014 Kring ..... A61B 17/132 128/845
2004/0168246 A1 9/2004 Phillips
2008/0077151 A1 * 3/2008 Kring ..... A61B 17/132 606/88
2013/0032156 A1 * 2/2013 Kring ..... A61B 17/132 128/882

* cited by examiner

*Primary Examiner* — Eric J Kurilla
*Assistant Examiner* — Amanda L Bailey
(74) *Attorney, Agent, or Firm* — Garvey, Smith & Nehrbass, Patent Attorneys, L.L.C.; Charles C. Garvey, Jr.; Vanessa M. D'Souza

(57) ABSTRACT

An improved method and apparatus for restraining a patient's leg during knee surgery or similar procedure features and improved restraining member that is attachable to an operating room table. The restraining member has a lower concave portion that engages the upper portion and sides of the patient's leg. The restraining member has an upper convex portion that is reinforced with a plurality of ridges. The concave portion can be fitted with an inflatable bladder. The concave portion in other embodiments is fitted with a belt arrangement that enables different degrees of constriction to be imparted to the leg. In one embodiment, a base or cradle supports the leg from below. A top arc member is removably attachable to the base or cradle (pivotal connection or sliding connection). The top arc member is movable between open and closed positions.

20 Claims, 21 Drawing Sheets

KNEE RESTRAINT SYSTEM

CROSS-REFERENCE TO RELATED APPLICATIONS

This application claims benefit of U.S. Provisional Patent Application No. 62/272,570, filed Dec. 29, 2015, which is hereby incorporated herein by reference and priority to/of which is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to devices for holding or securing the leg of a patient during knee arthroscopy surgery and any other medical procedures that require immobilizing of a patient's leg. More particularly, the present invention relates to a leg restraining apparatus that is connectable to an operating room table and that holds the patient's leg above the knee during knee surgery or like medical procedures. Even more particularly, the present invention relates to an improved method and apparatus for restraining the leg of a patient above the knee wherein a specially configured restraining member is equipped in one embodiment with an inflatable bladder that interfaces between the restraining member and the patient's leg and in other embodiments, cradles the leg both above and below and in other embodiments, provides an interlocking ratcheting mechanism that enables a surgeon to selectively tighten the device around the patient's leg.

In one embodiment, an air bladder with an air intake hose can be attached for the purpose of inflation and deflation of the bladder as needed for surgical support.

2. General Background of the Invention

During numerous medical procedures, the leg of a patient must be restrained. For example, a patient's leg must be restrained during knee surgery.

There is a prior U.S. Pat. No. 4,766,892 issued to Gary Krietman that discloses a leg restraint device adapted for orthopedic examinations and operating procedures that provides a firm support for a portion of a patient's limb while the limb or joint is manipulated or stressed. The restraint includes a rigid frame which defines a partially enclosed area within which the patient's limb is inserted. The enclosed area of the frame accommodates a blood pressure type air bag cuff which is secured to the frame by a fastener. Restraintive force is applied to the limb and monitored by pressurizing the air bag to a controlled level. In one embodiment, the partially enclosed area is shaped as an inverted "U" and with the operating table providing the bottom closure. In a further embodiment, the frame includes a horizontal weigh which extends along the operating table and terminates at an upward laterally curved jaw. An adjustable medially curved jaw is positioned along the weight.

After the adjustable jaw has been positioned, the air bag is pressurized to restrain the limb.

The present invention is an improvement of the device shown in the Krietman U.S. Pat. No. 4,766,892.

U.S. Provisional Patent Application No. 62/124,628, filed Dec. 29, 2014; and U.S. Provisional Patent Application No. 62/128,664, filed Mar. 5, 2015, are each hereby incorporated by reference.

The following are also hereby incorporated herein by reference:

U.S. patent application Ser. No. 14/246,488, filed Apr. 7, 2014, which is a continuation of U.S. patent application Ser. No. 13/570,624, filed Aug. 9, 2012 (now U.S. Pat. No. 8,689,793, issued Apr. 8, 2014), which is a continuation in part of U.S. patent application Ser. No. 11/566,485, filed Dec. 4, 2006, which claims the benefit of U.S. Provisional Patent Application Ser. No. 60/845,833, filed Sep. 19, 2006, U.S. Provisional Patent Application Ser. No. 60/816,842, filed Jun. 27, 2006, U.S. Provisional Patent Application Ser. No. 60/794,164, filed Apr. 24, 2006, and U.S. Provisional Patent Application Ser. No. 60/761,402, filed Jan. 23, 2006, each of which is hereby incorporated herein by reference.

U.S. Provisional Patent Application No. 62/124,628, filed Dec. 29, 2014; and U.S. Provisional Patent Application No. 62/128,664, filed 5 Mar. 2015, each of which is hereby incorporated herein by reference.

BRIEF SUMMARY OF THE INVENTION

The method and apparatus of the present invention preferably incorporates the use of polycarbonate materials combined with an air bladder to fixate the leg for the purposes of a medical procedure, such as knee arthroscopy and other procedures that include but are not limited to EP studies, vascular intervention via catheters, where the leg is required to remain immobile to facilitate the medical procedure.

The apparatus of the present invention is unique in its concept and structural design, preferably incorporating proprietary structural ridges and support biases, to provide the stiffness and strength characteristics to withstand a minimum of 50 lbs lateral force when flexing valgus and vargus angle pressure on the knee joint for arthroscopic knee surgery exposure.

The present invention preferably utilizes an intricate design of Celstran ridges, supports, cross members, and diagonal supports.

The apparatus of the present invention is designed to preferably be both a "disposable leg restraint", and/or a re-useable device in those markets that are not suited for a disposable device. Embodiments of the present invention can weigh between 1 and 2 pounds, more preferably between 1.5 and 2 pounds, and is made of about 60% glass polycarbonate material(s).

The present invention is light weight, can be disposable, and negates any cross contamination potential for infection and affords direct access to all points of the knee joint. The apparatus of the present invention preferably provides ease of use and set-up, cost effectiveness by avoiding re-sterilization, cleaning, and administrative costs such as record keeping and liability costs.

The apparatus of the present invention preferably does not act as a tourniquet, and allows for continuation of procedure during long cases requiring release of tourniquet, permits limited blood flow-safety factor. The apparatus of the present invention provides enhanced patient comfort and safety via air bladder that insures equal distribution of stress forces. The apparatus of the present invention can be sterile draped and is readily removable during surgical procedure (w/o breaking sterility) extending operative field.

The apparatus of the present invention can be manufactured as a single molded piece and/or a two section piece incorporating a metal stem (SS/titanium/etc.) attached to a polycarbonate arc that supports the air bladder cushion system for immobilizing the leg.

The materials can comprise 60% long strand glass and polycarbonate plastics (e.g. Celstran PA66-GF60-02-BK) and can be produced in a variety of colors (black, natural, yellow, red, blue).

In one embodiment, an optional bottom attachment can be used to connect the proximal portion of the arc and the distal end of the arc, in the event that it might be required to provide addition stiffness to the overall brace. The attachment would be passive, merely clipping into place, and supporting additional lateral force, should it be needed.

In one embodiment of the present invention incorporates a unique approach to fixating the leg via two methods. In a first method, a base (e.g. Celestran) with interlocking teeth on both sides of the base preferably engage two semicircular pieces that complete the encirclement of the leg, around a circular foam padding (adjusts for size). The operator merely tightens the encircling pieces to the desired tension/fixation position by pressing inward and engaging the next set of teeth on the ends of the two encircling pieces.

The tension of encirclement increases the engagement on the teeth since all the pressure is outward keeping the teeth well engaged into one another. To release, one merely pulls upward on the piece with the handle, and the system of encirclement releases pressure totally, allowing for the removal of the device after the procedure. The attached drawings clearly depict the construction and design of the device, alluding to the unique structural supports required to withstand the lateral pressures of knee surgery requirements.

In another procedure and embodiment, a base that is somewhat larger and more encompassing than "a" provides a more stabilizing structure to attach a ridged belt that serves to encircle the leg, pass through a geared mechanism that has a locking pin to immobilize the gear and fix the belt at the desired point of tension/fixation.

The tension on the belt is preferably achieved by merely pulling downward/outward on the belt as it passes thru the gear and out of the base housing, and at the desired tension is fixed by engaging the locking pin to the gear. This locks the belt in place, and it cannot be released without disengaging the locking pin.

The ridged belt can be padded with a foam pad between the belt and the patient's leg. Either of these devices can be manufactured as "disposable" devices, and re-useable devices for those markets that do not lend themselves to disposable products. The foam pads would be a disposable item helping to eliminate the potential for cross contamination and/or infection on both embodiments. These devices can be manufactured as a single base portion with the above described attachments/components, and are unique in design and concept for fixating a leg for the purposes of providing leg stability for medical procedures such as arthroscopic knee surgery and any other medical procedures that require the use of keeping the leg immobile (such as EP studies, vascular catheter intervention—angioplasty and/or stent placement). The first embodiment preferably involves the use of an air bladder and does not totally encircle the leg tension. The second embodiment does in fact encircle the leg and preferably does perform a limited tourniquet effect, while not employing the air bladder. Both embodiments are for practical purposes, aside of design and mechanical function, preferably provide the same features, benefits and advantages. Both can be disposable in nature or re-useable as well. The re-useable model in both embodiments would incorporate a disposable feature. The "air bladder" could be a disposable item. The foam pad would be a disposable item. When designated as a single use device, the entire device would be disposed of after each use.

The present invention includes a limb restraining apparatus for use in combination with a table upon which a patient is resting, comprising: a restraining member removably attached to the table, the restraining member being an integrally molded plastic member having a curved underside concave portion that is positioned to cradle the patient's leg from a position above the patient's leg; the restraining member preventing substantial movement of the patient's limb while allowing movement and manipulation of a distal limb section; a flexible support attached to the concave portion of the restraining member; and the upper surface of the restraining member being a convex surface that is reinforced with a plurality of webs that intersect to form acute angles.

Preferably, flexible support can be an inflatable cuff.

Preferably, the present invention further comprises a cradle that can removably fit the restraining member, the cradle having an upwardly facing concavity that cradles the patient's leg from below.

Optionally, the restraining member can be of a polycarbonate material.

Optionally, the restraining member can be of a glass polycarbonate blend.

Optionally, the restraining member can be of in excess of 50% long strand glass and polycarbonate plastic material.

Preferably, the cuff includes an inflation stem, the restraining member preferably including an aperture, the stem preferably extending through the aperture to facilitate inflation.

The present invention includes a method of accessing areas of a limb joint for insertion and manipulation of arthroscopic instruments during arthroscopic examination or surgery, the method comprising the steps of: preferably confining a first zone of a limb with a restraining member that has a downwardly facing concavity that covers the top and at least part of the sides of the limb, the restraining member preferably including on the inside an air bag cuff, the first zone being positioned between the patient's body and the joint, the restraining member preferably including on the outside a plurality of structural ridges that form multiple acute angles; immobilizing the air bag cuff; inflating the cuff to a minimum predetermined pressure to restrain the first zone from movement; monitoring and maintaining the inflating pressure while stressing the limb joint, the stressing of the joint being attained by applying forces to a second zone of the limb, the second zone being spaced from the joint in a direction away from the patient's body.

Preferably, the limb is a leg, the joint comprising a knee joint, the first zone comprising a portion of a thigh, the step of immobilizing the air bag cuff comprising immobilizing the cuff adjacent the top and opposite sides of the thigh.

Preferably, the confining step includes positioning the cuff only around the top and sides of the thigh, the underside of the thigh being free of contact with the inflated cuff.

Preferably, the joint can be stressed by applying rotational stress to the second zone relative to the first zone.

Preferably, the step of immobilizing the cuff comprises fixing the cuff with respect to a rigid frame, the frame being operatively positioned to overlie the air bag cuff, the fixing step comprising peripherally securing the cuff to the frame, the frame being spaced from the first zone.

The present invention includes a method of restraining a portion of a limb of a patent resting upon a surgical table for orthopedic examination and operating procedures upon a joint of the limb, the method comprising the steps of: providing a restraining member having a rigid support that surrounds the top and sides of the limb to be restrained, said restraining member having an upper convex surface reinforced with a plurality of intersecting ridges and a lower concave surface that engages a patient's leg, and an inflatable cuff on the lower curved surface; registering the restraining member with a first zone of the limb, the first zone being spaced from the joint in a direction towards the patient's torso by adjustably anchoring the rigid support means to the table at a selected position along the length of the table, the support means being out of direct contact with the limb; peripherally confining the first zone of the limb except for an underside portion of the first zone resting upon the surgical table with the inflatable cuff; applying restraintive force to the first zone by inflating the cuff to a pressure while immobilizing portions of the cuff spaced from the first zone of the limb with the rigid support means; monitoring and maintaining the inflated pressure of the cuff for the duration of the operating procedure; and separating portions of the joint to permit the insertion and manipulation of arthroscopic instruments by applying controlled forces to a second zone of the limb, the second zone being spaced from the joint in a direction away from the first zone.

Preferably, the cuff includes an outer periphery, the step of inflating and immobilizing the cuff includes the step of anchoring the cuff to the restraining member.

Preferably, the restraining member includes a plastic frame having a depending leg, the step of anchoring including anchoring the restraining member to the table by inserting the flange into a slot which provided on the table.

The present invention includes a method of stabilizing and rendering immobile the thigh area of a patient for cardiovascular intervention procedures involving the placement of catheters and/or instruments in the patient's cardiovascular system via the femoral arterial vessel, whereby catheter placement and maintenance of position is vital to successful angioplasty intervention and/or placement of arterial stents.

The present invention includes a limb restraining apparatus for use in combination with a table upon which a patient is resting, comprising: a restraining member removably attached to the table, the restraining member being an integrally molded plastic member having a curved underside concave portion that is positioned to cradle the patient's leg from a position above the patient's leg; the restraining member preventing substantial movement of the patient's limb while allowing movement and manipulation of a distal limb section; a flexible belt attached to the restraining member, the belt extending about 360 degrees for encircling and holding a patient's leg; and interlocking portions of the belt enabling the belt to adjust to legs of differing sizes.

Preferably, the belt has multiple sections.

Preferably, the belt has interlocking toothed portions.

Preferably, the belt has a handle at one end portion for enabling tension to be applied to the belt.

Preferably, the belt has belt teeth on a surface of the belt and further comprising a toothed wheel on the restraining member that engages the belt teeth.

Preferably, the toothed wheel can be rotated to tighten or loosen the belt about a patient's leg.

Preferably, the belt has teeth on a belt outer surface, the belt having an inner surface that engages the patient's leg.

Preferably, there is a locking device that locks movement of the belt and wheel in a selected position.

Preferably, the locking device comprises apertures on the wheel and a locking pin that can interlock with a selected one of the apertures.

The present invention includes a tourniquet in order to lower the position of the tourniquet from the high thigh to proximal to the knee joint, thus reducing potential tissue and vascular damage caused by the tourniquet on the upper thigh area.

The present invention can be used for procedures including ACL repairs, arthroscopy meniscus repair, and vascular intervention.

The present invention includes a single device with no moving parts and/or attachments. The present invention does not require added bottom support. The present invention can be used on various patients, including small school soccer players, older athletes, adults and elderly (both slim and obese).

In the present invention, a surgeon can use the device for quick case repairs. Using the device of the present invention, a surgeon can perform a surgery in a seated position. The present invention saves time and costs. Patients benefit from the comfort and stability of the present invention. There is less operative time and lower costs associated with use of the present invention. One other advantage is that the apparatus of the present invention standardizes the arthroscopic procedure approach for every patient. The device is easy to set up and avoids MCL tears during surgery that would occur using another apparatus.

The present invention includes a method of accessing areas of a leg joint of a patient who is supported upon an operating room table, for insertion and manipulation of arthroscopic instruments during surgical arthroscopic examination of the patient's leg joint. The method provides a restraining member that removably attaches to the operating room table, the restraining member having a connecting portion that includes a flange and that attaches to the table, a curved section having a free end, and a thickened transition section that joins the connecting flange to the curved section, the transition section having a first tapered portion connecting to the flange and a second tapered portion connected to the curved section, said first and second tapered sections joined together. A first zone of the patient's leg can be confined with the restraining member, wherein the restraining member covers the top and part of the sides of the patient's leg, but does not engage the underside of the patient's leg that rests upon the operating room table. The curved section can extend over but does not encircle the patient's leg.

In one embodiment, the joint can comprise the patient's knee joint, the first zone can comprise a portion of the patient's thigh, and further comprises the step of selectively immobilizing the leg with an inflatable cuff adjacent the top and sides of the patient's thigh by inflation of said cuff.

In one embodiment, the cuff can be placed only around the top and sides of the patient's thigh, the underside of the thigh being free of contact with the inflatable cuff.

In one embodiment, the patient's leg joint can be stressed by applying rotational stress to a second zone of the patient's leg relative to the said first zone.

In one embodiment, the inflatable cuff can be not connected to the patient's thigh at a position spaced proximally of the restraining member.

The present invention includes a method of restraining a portion of a leg of a patient resting upon a surgical table for orthopedic examination upon a knee joint of the patient's leg. The method can provide a restraining member having a rigid curved support that surrounds the top and sides of the leg to be restrained, said restraining member having a lower concave curved surface that engages the patient's leg, and an inflatable cuff on the lower concave curved surface. The restraining member can be registered with a first zone of the patient's leg above the knee, the first zone being spaced from the knee joint in a direction towards the patient's torso by adjustably anchoring the rigid support member to the table at a selected position along the length of the table. The first zone of the leg can be peripherally confined with the curved support. The underside of the patient's leg can be rested upon the surgical table. Portions of the joint can be separated to permit the insertion and manipulation of arthroscopic instruments by applying controlled forces to a second zone of the leg below the knee, the second zone being spaced from the knee joint in a direction away from the first zone. The restraining member does not encircle the patient's leg in any of the steps.

In one embodiment, the inflatable cuff can be connected to the curved support and further comprise selectively inflating the cuff.

In one embodiment, the restraining member can include a plastic frame having a flange and anchoring the flange to the table by inserting the flange into a slot on the table.

The present invention includes a leg restraining apparatus for use in knee surgery wherein a patient is resting on an operating room table. The invention can comprise a restraining member removably attached to the said table, the restraining member being an integrally molded, generally semicircular plastic member having a curved underside concave portion that can be sized and shaped to conform the patient's leg from a position above the patient's leg. The restraining member can prevent substantial movement of the patient's leg while allowing movement and manipulation of the patient's distal leg section. An inflatable cuff can be attached to the restraining member, the cuff extending only a partial distance around the patient's leg including engaging the upper surface of the patient's leg but not the underside of the patient's leg.

The present invention includes a leg restraining apparatus for use in knee surgery and in combination with a surgical table upon which a patient is resting. The invention includes a restraining member that can be removably attached to the table, the restraining member being an integrally molded plastic member having a curved section with an underside concave surface that is positioned to cradle part of the patient's leg from a position above the patient's leg. The restraining member can prevent substantial movement of the patient's leg while allowing movement and manipulation of that patient's distal leg section below the patient's knee. The restraining member can have a connector that enables connection to the table. The restraining member can have a thickened section in between the connector and the curved section, the thickened section including first and second tapered sections that are joined at a location of maximum cross sectional area of the thickened section.

In one embodiment, the present invention can further comprise an inflatable cuff attached to said curved section.

In one embodiment, the inflatable cuff does not encircle the patient's leg.

In one embodiment, the present invention can further comprise a cradle that can be removably connectable to the restraining member, the cradle having an upwardly facing concavity that cradles the patient's leg from below.

In one embodiment, the restraining member can be of a polycarbonate material.

In one embodiment, the restraining member can be of a glass polycarbonate blend.

In one embodiment, the restraining member can be of in excess of 50% long strand glass and polycarbonate plastic material.

In one embodiment, the cuff can include an aperture, the connector extending through the aperture to facilitate inflation.

In one embodiment, the restraining member extends about half way around the patient's leg.

In one embodiment, the first tapered section can be attached to the connector and a second tapered section can be attached to the curved section, wherein the first tapered section has a smallest cross sectional area next to the connector.

In one embodiment, the first tapered section can be attached to the connector and the second tapered section can be attached to the curved section, wherein the second tapered section has a smallest cross sectional area next to the curved section.

In one embodiment, the first tapered section can have two surfaces that form an acute angle.

In one embodiment, the second tapered section can have two surfaces that form an acute angle.

In one embodiment, an obtuse angle can be formed by one surface of the first tapered section and one surface of the second tapered section.

In various embodiments, an air bladder with an air intake hose can be attached to a leg restraint apparatus for the purpose of inflation and deflation of the bladder as needed for surgical support.

Another embodiment incorporates the use of two sliding locks (or for example two ball and socket like connectors) to hold the top arc in place during surgery. This alternate embodiment is basically configured similar to the previous embodiments, a major difference being that the top arc opens to allow the surgeon to operate on a horizontal or table set-up, and flex the knee joint upwards following anterior cruciate ligament (ACL) repair to test the integrity of the new ACL ligament following attachment. This alternate embodiment would also be used by those surgeons that prefer to operate standing up on a flat or table rather than seated. The materials can be similar to the previous embodiments. New versions can be used that incorporate carbon fibers to make the material substantially stronger and more rigid than the other polycarbonate material (e.g., EMS Grivory 7H).

The scope and application of this alternate embodiment remains identical to the other embodiments, but changes the final approach to testing the knee by flexing it upward from a flat operating room table versus one with the end at 90 degrees plus. The advantage of this alternate embodiment is to enable those performing ACL repairs on a flat operating room table (horizontal), having the ease of swinging the upper arc out of the way to perform the "flex" test after attaching a new ACL.

This system of the alternate embodiments is easier, self-contained without having to remove any parts, and readily locks back in place should it be required to continue the surgical repair. It is light weight, easy to operate, and has all the properties of a SS device (strength and rigidity) without the cumbersome aspects of a heavy and robust device.

The new device of the alternate embodiments can be manufactured with carbon fiber polycarbonates or molded of polycarbonates with long strand glass fibers, and/or carbon fibers, resulting in weight loss and increased strength and rigidity.

Another embodiment of the present invention includes the top arc preferably swinging upward to an open position. It can preferably rotate to about 180 degrees. The opposite end can preferably lock in place with a sliding slot, keeping it from opening up during a surgical procedure. The size and shape can preferably be very similar to the other embodiments in width and thickness, and can be made with the same polycarbonate materials disclosed herein. It can be made of material that can be molded.

The device of the alternate embodiments can weigh between 1 and 2 pounds, more preferably between 1.5 and 2 pounds, and most preferably about 2 pounds.

The leg restraint can have the top arc attach via a sliding slot on both ends, thus to remove the top arc one would release the slots and pull the top arc totally out of position.

An alternate embodiment thus provides a knee restraint system (KRS) specifically for use in ACL surgical repairs. Construction can be similar to the other embodiment, along with its structural supports and scaffolding; the stem can preferably be the same size and dimensions as prior embodiments, as well as the width of the arc and basic structure of the base.

An alternate embodiment allows the surgeon to remove the top arc portion after attachment of the ACL ligament, to test the knee flexibility to about 90 degrees and without breaking sterility. The surgeon can replace the arc for further surgical intervention should it be required. An air bladder can be preferably used with a small modification, adding an open slot for placement on the opposite side of the inflation port. In addition, there is the option of using a foam ring in the event that it is called for or desired by surgeons.

The materials can be from EMS Grivory, polycarbonates, or any stronger, lighter materials.

In various embodiments, the top arc can preferably slide on and affix to the base via a ball joint sliding into an oval cavity of similar dimensions with enough play to allow for smooth horizontal movement on and off.

An air bladder can preferably perform the same functions as the other embodiments, providing for sizing of diverse patient legs when placed within the restraint system.

Various embodiments allow the surgeon to preferably raise the knee joint post ACL repair (as many do today) thus fully covering all aspects of the knee arthroscopy surgical process. Alternate embodiments incorporate a top arc that preferably slides off post implant of the ACL ligament, preferably enabling the surgeon to raise the knee joint past 90 degrees testing the implant integrity.

Various embodiments preferably enable surgeons to use the flat table approach as compared to the doing the procedure sitting and merely letting the lower leg flex downward to 90 degrees. The top arc can be capable of sliding off during surgery for this crucial test, and then replaced again should further surgical intervention be required. The top arc attachment can be via ball point on the arc, and preferably a corresponding slot in the leg restraint support arms on both sides. The major pressure point can preferably be on either lateral support, and less towards the top and/or upward pressure. The edges of the structure/support arms can be rounded on both sides in order to increase patient safety and comfort while the surgeon manipulates the leg/knee joint during surgery. The device can preferably employ a similar air bladder as the other embodiments as well to better size a patient's thigh/leg.

A key feature of alternate embodiments is preferably for the upper arc portion to either rotate upward so that the leg can be raised from a horizontal position to a 90 degree knee flex after ACL repair, so that the tendon repair can be tested for tension and stability. The upper arc can preferably rotate upward and a pin can preferably act as the axle on which it can lift. A hook-like engagement design on the opposite end of the arc can preferably hold in place as pressure from the air bladder preferably keeps it locked in place. It would also allow for a design change so that the upper arc slides out (backward towards the patient's torso), and then allow the flexing of the knee joint to 90 degrees. This embodiment can basically use the same air bladder concept as earlier embodiments; but it would also allow for the use of a split foam ring in the place of the air bladder should it be desired.

The width and basic construction design of alternate embodiments can be identical to the previous embodiments. The rigidity/strength/overall performance also can equal the other previous embodiments. The stem of the alternate embodiment can preferably be identical to the earlier embodiments.

In various alternate embodiments, the top arc can preferably swing upward/open and it can preferably rotate to about 180 degrees. The opposite end can preferably lock in place with a sliding slot, keeping it from opening up during a surgical procedure. The size and shape can be very similar to the earlier embodiments, in width and thickness, and can preferably be the same polycarbonate materials (e.g., can be molded).

Another option for alternate embodiments of the leg restraint can be to have the top arc preferably attach via a sliding slot on both ends, thus to remove the arc one would preferably release the slots and pull the top arc totally out of position. All other aspects preferably remain the same. This alternate design can incorporate the use of two sliding locks to hold the top arc in place during surgery.

The application of the alternative embodiments is exactly the same as the previous embodiments, a difference being that the top arc preferably opens to allow the surgeon to operate on a horizontal operating room (OR) table set-up, and flex the knee joint upwards following ACL repair to test the integrity of the new ACL ligament following attachment. This embodiment can also be used by those surgeons that prefer to operate standing up on a flat operating room table rather than seated.

The present invention includes a method of accessing areas of a leg joint of a patient who is supported upon an operating room table, for insertion and manipulation of arthroscopic instruments during surgical arthroscopic examination of the patient's leg joint. The method of the present invention includes providing a restraining member that preferably removably attaches to the operating room table, the restraining member having a connecting portion that preferably includes a flange and that attaches to the table, a cradle section having a concave portion. A curved top arc can be provided that is preferably pivotally attached to the cradle. The patient's leg can be confined with the cradle and top arc, wherein the top arc preferably covers the top and part of the sides of the patient's leg, but does not engage the underside of the patient's leg. The cradle can preferably be placed under but does not encircle the patient's leg. The top arc can be opened or closed to selectively restrain or enable release of the patient's leg such as when a surgeon wants to flex the leg after knee surgery on the patient.

In one embodiment, the method further comprises the step of selectively immobilizing the leg with an inflatable cuff adjacent the patient's leg by inflation of said cuff.

In one embodiment, the cuff can be placed only around a part of the leg.

The present invention includes method of restraining a portion of a leg of a patient resting upon a surgical table. The method includes providing a restraining member having a rigid curved base that preferably cradles the underside of the leg to be restrained, said restraining member having a lower concave curved surface that engages the patient's leg, and an attached top arc member. The restraining member can be registered with the patient's leg at the knee, wherein the top arc attaches to the base in a closed position. The underside of the patient's leg can rest upon the base. The base and top arc member preferably encircle the patient's leg in the closed position. The top arc member can be movable to an open position that preferably allows the surgeon to flex the patient's leg and bend the patient's knee.

In one embodiment, an inflatable cuff can be connected to the restraining member and selectively inflating the cuff.

The present invention includes a leg restraining apparatus for use in knee surgery wherein a patient is resting on an operating room table. The apparatus includes a restraining member preferably removably attached to the said table, the restraining member having a base with a curved concave portion that is preferably sized and shaped to conform the patient's leg and a curved arc shaped member attached to the base. The restraining member preferably preventing substantial movement of the patient's leg when the arc shaped member is closed. An open position of the arc shaped member preferably enables the surgeon to flex the patient's leg and knee, elevating the patient's leg above the base.

The present invention includes a leg restraining apparatus for use in knee surgery and in combination with a surgical table upon which a patient is resting. The apparatus includes a restraining member preferably removably attached to the table, the restraining member having a base member with a curved concave section that is positioned to cradle part of the patient's leg. The restraining member preferably including a curved arc member preventing substantial movement of the patient's leg when the curved arc member is in a closed position. The restraining member preferably having a connector that enables connection to the table. An open position of the arc shaped member preferably enables the surgeon to flex the patient's leg and knee, elevating the patient's leg above the base.

In one embodiment, further comprising an inflatable cuff preferably attached to said restraining member.

In one embodiment, the base can be a cradle having an upwardly facing concavity that cradles the patient's leg from below.

In one embodiment, the restraining member can be of a polycarbonate material.

In one embodiment, the restraining member can be of a glass polycarbonate blend.

In one embodiment, the restraining member can be of in excess of 50% long strand glass and polycarbonate plastic material.

In one embodiment, the restraining member base preferably extends about half way around the patient's leg.

The present invention includes a leg restraining apparatus for use in knee surgery wherein a patient is resting on an operating room table. A base portion can be removably attached to the operating room table, the base portion preferably having a flange removably connected to the table and a cradle with a concavity that is configured to cradle part of the patient's leg in said concavity. An arc can have spaced apart connectors that removably attach to the base portion. The arc can prevent substantial movement of the patient's leg when the connectors are attached to said base portion. Removal of the arc from the base portion preferably enables a surgeon to flex the patient's leg and knee, elevating the patient's leg above the base portion.

In various embodiments, the arc can be a sliding bar.

In various embodiments, the connectors can slidably attach to the base portion.

In various embodiments, the connectors can be ball and socket connectors.

In various embodiments, the connectors preferably enable separation of the arc from the base portion by sliding the arch longitudinally.

In various embodiments, further comprising an inflatable cuff attached to the base portion.

In various embodiments, further comprising an inflatable cuff attached to the arc.

In various embodiments, further comprising an inflatable cuff attached to the base portion and arc.

In various embodiments, the concavity preferably cradles the patient's leg from below.

In various embodiments, the restraining member can be of a polycarbonate material.

In various embodiments, the restraining member can be of a glass polycarbonate blend.

In various embodiments, the restraining member can be of in excess of 50% long strand glass and polycarbonate plastic material.

In various embodiments, the base portion preferably extends about half way around the patient's leg.

The present invention includes a method of restraining a portion of a leg of a patient resting upon an operating table. A base portion can be provided and that removably attaches to the operating room table, the base portion having a flange that preferably removably connects to the table and a cradle with a concave curved surface that preferably cradles the underside of the patient's leg. A curved top arc can be provided and having spaced apart connectors that preferably slidably attach to the cradle. The patient's leg can be restrained with the cradle and top arc, wherein the connectors are attached to the cradle and the top arc covers the top and part of the sides of the patient's leg, but does not engage the underside of the patient's leg. The top arc can be slidably connected to the cradle to selectively restrain or enable release of the patient's leg such as when a surgeon wants to flex the leg after knee surgery on the patient.

In various embodiments, further comprising the step of selectively immobilizing the leg with an inflatable cuff adjacent the patient's leg by inflation of said cuff.

In various embodiments, wherein the cuff can be placed only around a part of the leg.

In various embodiments, an inflatable cuff can be connected to the base portion and selectively inflating the cuff.

In various embodiments, an inflatable cuff can be connected to the arc and selectively inflating the cuff.

In various embodiments, an inflatable cuff can be connected to the arc and base portion and selectively inflating the cuff.

In various embodiments, the arc can be a sliding bar.

In various embodiments, the connectors can be ball and socket connectors.

In various embodiments, the connectors preferably enable release of the top arc from the cradle by sliding the arc longitudinally.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 7:
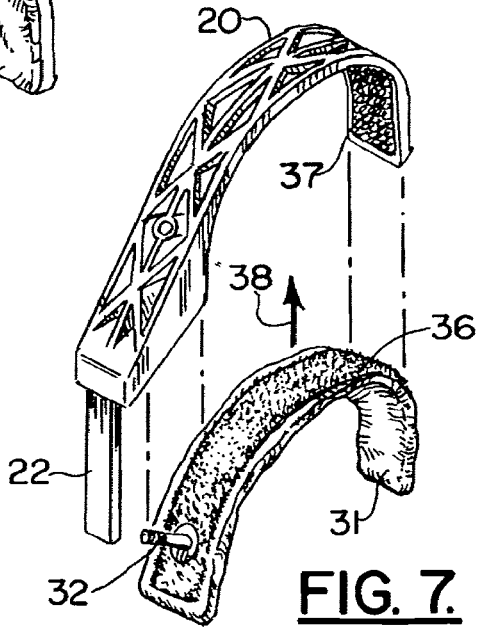
FIG. 7 is a partial perspective view of an embodiment of the apparatus of the present invention.
Figure 8:
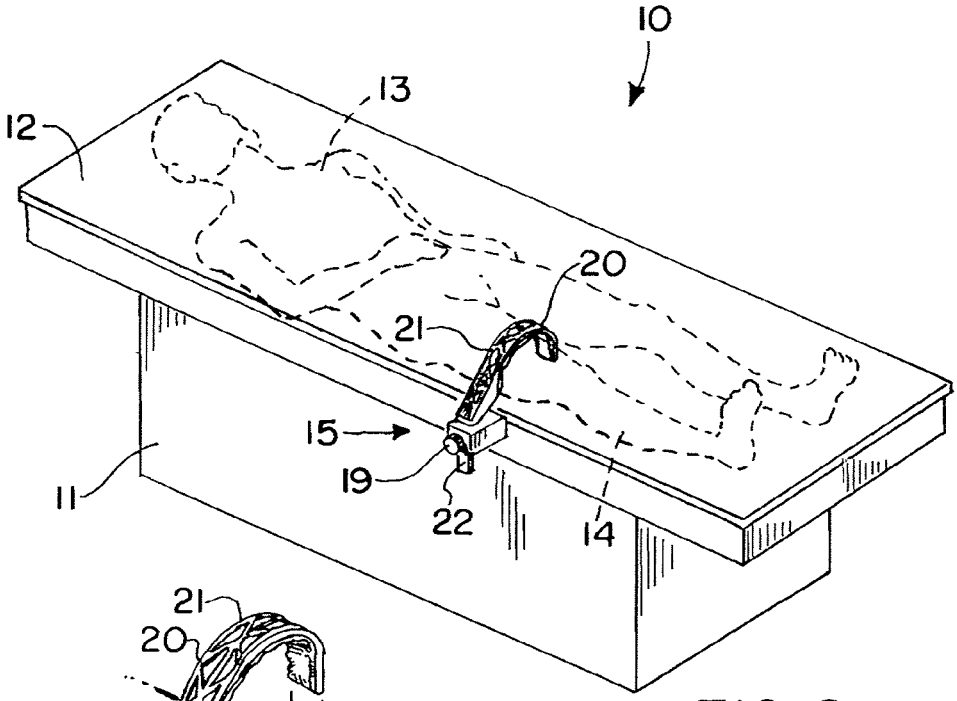
FIG. 8 is a perspective view of an embodiment of the apparatus of the present invention.
Figure 9:
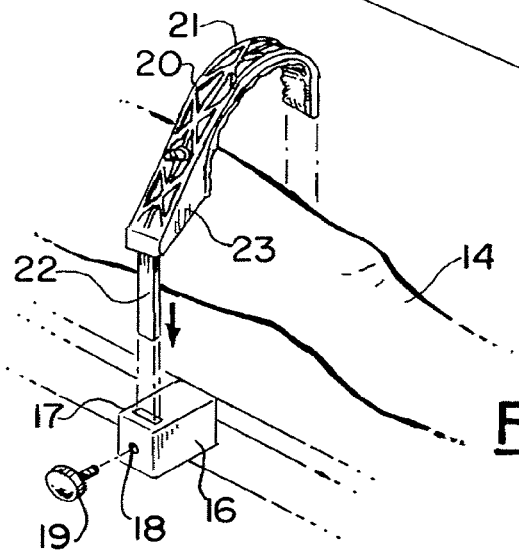
FIG. 9 is a fragmentary perspective exploded view of an embodiment of the apparatus of the present invention.
Figure 10:
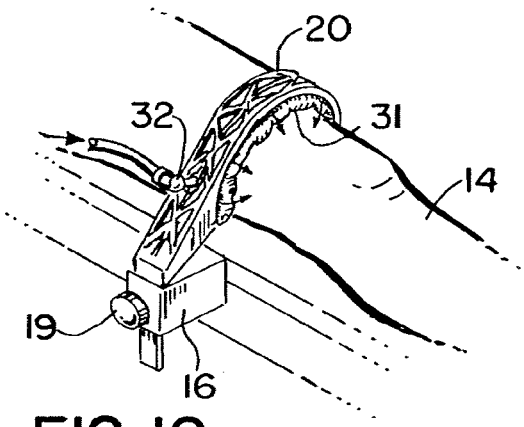
FIG. 10 is a close-up perspective view of an embodiment of the apparatus of the present invention.

FIGS. 1-10 show an embodiment of the apparatus of the present invention designated generally by the numeral 10 in FIG. 8.

Leg restraint apparatus 10 is shown in use in FIG. 8 with a standard operating room table 11 having an upper surface 12 that is receptive of a patient 13. During certain types of orthopedic examination procedures or surgeries, it is necessary to restrain or immobilize a patient's leg 14. A locking mechanism 15 is used in combination with table 11 to hold the leg 14 of a patient 13. The locking mechanism 15 includes a body 16 that is mounted to the table 11. The body 16 provides a vertical slot 17 intersected laterally with an internally threaded opening 18 that is receptive of threaded set screw 19. In this fashion, restraining member 20 or 20A or 20B can be inserted into slot 17 and then clamped and rigidly held to body 16 when set screw 19 is tightened relative to body 16. Operating room tables 11 typically have instrumentation holders for varied apparatus that slide along table rails for positioning, then clamped down in accordance with the patient's height/size.

The restraining member 20, 20A, 20B can include a vertical or mounting flange 22 to which is integrally attached a thickened section 23 and a curved section 21. The restraining member 20, 20A, 20B is of a disposable plastic material, such as of injection molded plastic.

Figure 1:
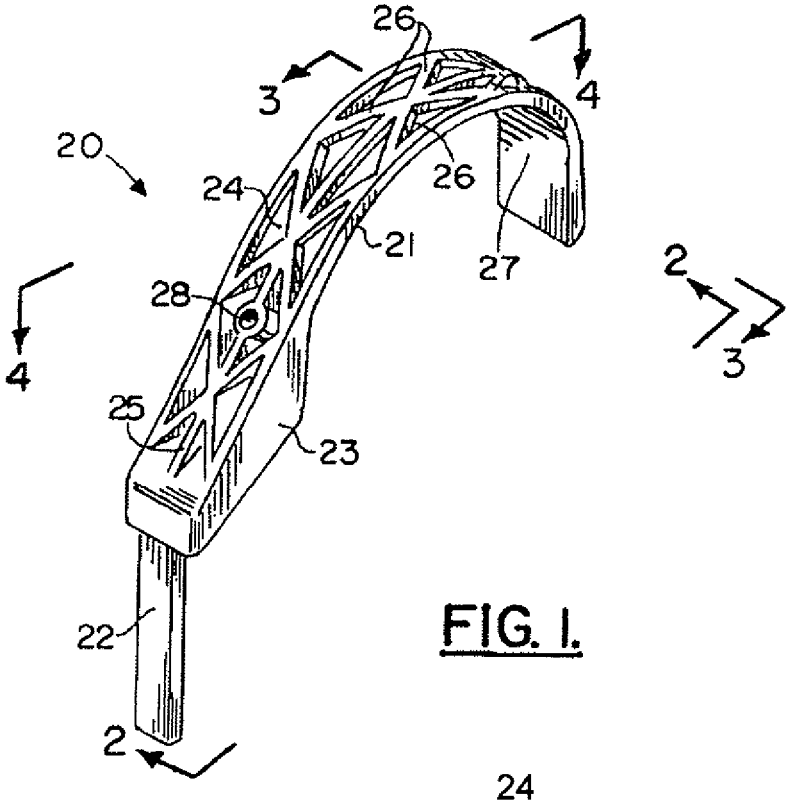
FIG. 1 is a fragmentary perspective view of an embodiment of the apparatus of the present invention.
Figure 2:
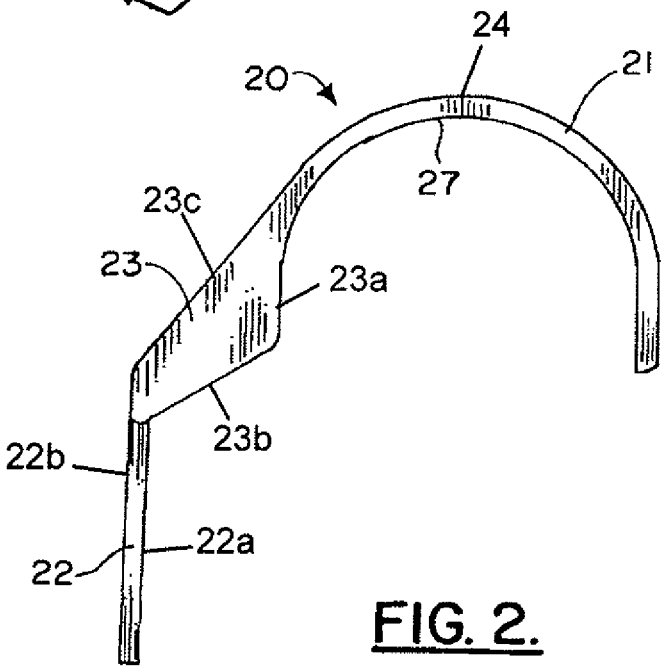
FIG. 2 is a sectional view taken along lines 2-2 of FIG. 1.
Figure 3:
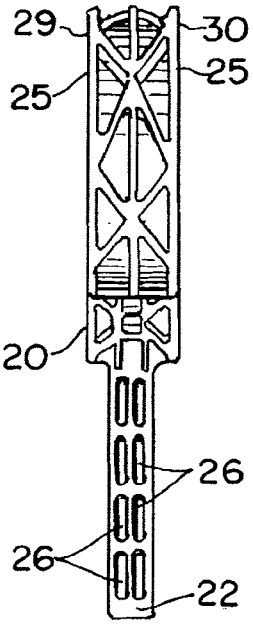
FIG. 3 is a sectional view taken along lines 3-3 of FIG. 1.

Curved section 21 provides an upper surface 24 that is reinforced with a plurality of longitudinal webs 25 and a plurality of diagonally positioned webs 26. Lower surface 27 of curved section 21 is preferably smooth, as shown in FIGS. 1 and 2. As seen in FIG. 2, flange 22 has inner surface 22*a* and outer surface 22*b*. Thickened section 23 has surfaces 23*a*, 23*b*, 23*c*. Surfaces 22*a*, 23*b* form a first obtuse angle. Surfaces 22*b*, 23*c* form a second obtuse angle that is larger than the first obtuse angle.

The first obtuse angle created by surfaces 22*a* and 23*b* can be preferably 121°-125°, and most preferably 123°. The second obtuse angle created by surfaces 22*b* and 23*c* can be preferably 141°-145°, and most preferably 143°. This is preferably the angle range at which the thickened section 23 can be molded and therefore maintain the required rigidity and strength of the brace arc. A different angle could be used based on the different size of the overall arc/brace required, for example, to accommodate smaller or larger leg mass based on the size of a person. Adjusting the angle to a greater or a smaller angle would result in a reduced or increased arc facilitating the overall size of the brace and its use with different leg sizes. This variation of angle ranges would allow for extreme sizes and possibly rigidity and strength issues when made with hybrid materials. The angles as specified herein fit approximately 95% of the population due to the design and use of the air bladder/tourniquet technique. The design is further unique in that this angle arc interface allows for a singular device to address such a large population of patients requiring no further adjustment in order to perform the surgical procedures of meniscectomy and/or ACL repair. Furthermore, it allows for the implementation of a technique that does not require a tourniquet by applying partial restrictive pressure to blood vessels via the air bladder, combined with cold saline, to perform meniscus repairs (the air bladder does not circumvent the patient limb/leg). The aspect that the air bladder does not circumvent the limb is also unique, as other devices with air bladders and/or foam padding circumvent the limb.

Opening 28 extends between the upper surface 24 and lower surface 27. The leg restraining member 20 provides sides 29, 30 that are preferably flat and generally parallel.

In FIGS. 3-10, restraining member 20 is provided with an inflatable bladder 31. The bladder 31 can be supplied with air through a valve 32. As indicated by arrow 33 in FIG. 5, valve 32 can extend through opening 28. Inflatable bladder 31 can be attached to restraining member 20 using adhesive 34 as indicated by arrow 35 in FIG. 5.

Inflatable bladder 31 can be attached to restraining member 20 using a hook and loop or Velcro$_C$ type connection, the hook fasteners 36 being attached for example to inflatable bladder 31 while the loop fasteners 37 are provided on the curved surface 27 of restraining member 20. Arrow 38 in FIG. 7 illustrates an attachment of bladder 31 to restraining member 20 using a hook fastener 36 and loop fastener 37 connection.

Figure 11:
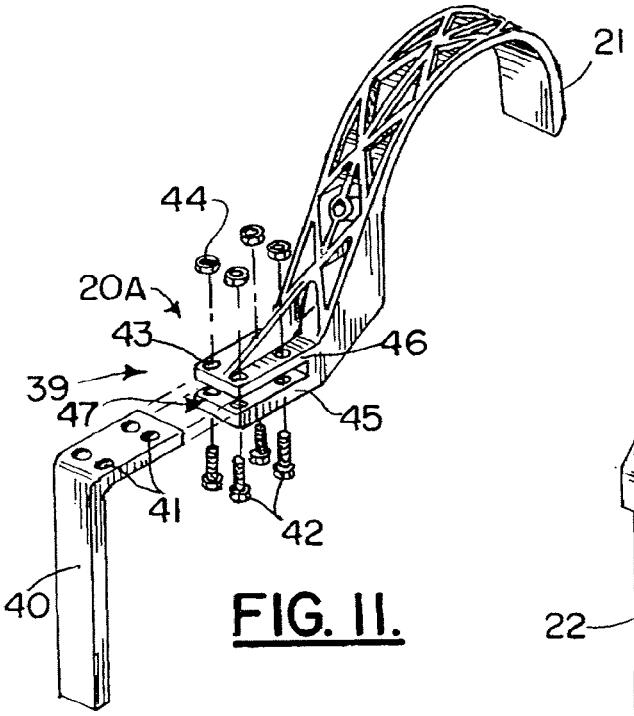
FIG. 11 is a fragmentary perspective view of an embodiment of the apparatus of the present invention illustrating a different construction for the restraining member.
Figure 12:
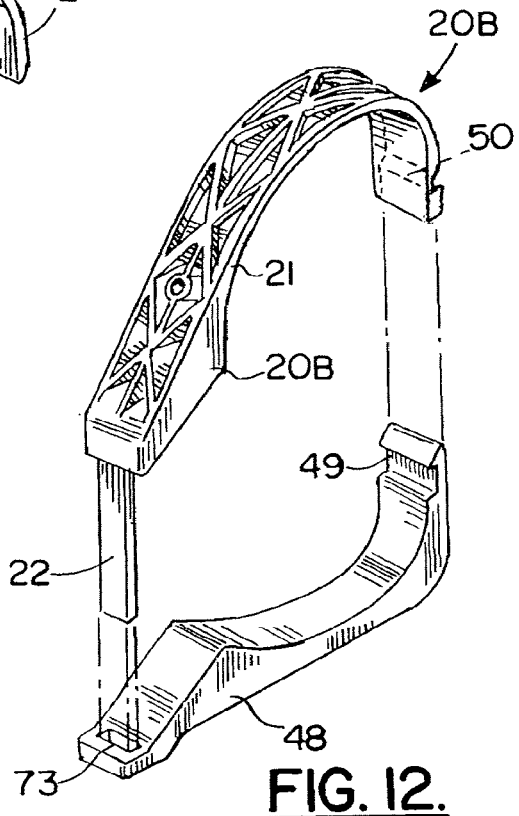
FIG. 12 is a fragmentary perspective view of an embodiment of the apparatus of the present invention illustrating a different construction for the restraining member.
Figure 13:
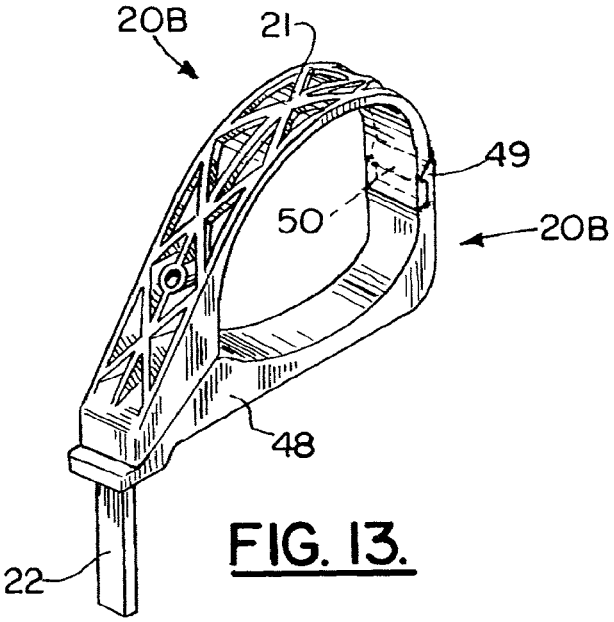
FIG. 13 is a fragmentary perspective view of an embodiment of the apparatus of the present invention illustrating a different construction for the restraining member.

In FIGS. 11-13, other arrangements of a restraining member are shown. In FIG. 11, restraining member 20A provides an ell shaped flanged member 40 that is separate from curved section 21, the parts 21, 40 being joined with a connection 39 that is formed by a plurality of openings 41 in flanged member 40 that align with openings 43 through flanges 45, 46 of curved section 21. The parts 21 and 40 being secured with one or more bolted connections that can include a plurality of bolts 42 and nuts 44 as shown in FIG. 11. Slot 47 provides a space in between the flanges 45, 46 that is receptive of flange member 40.

In FIGS. 12 and 13, the restraining member 20B is first threaded through a leg cradle 48 having a projection 49 that cooperates with and connects to a socket 50 provided on the restraining member 20B. In FIG. 13, the connection has been complete, the vertical flange 22 of restraining member 20B extending through opening 73 of cradle 48 and then being connectable to the body 16 as with the embodiment of FIGS. 1-10.

FIGS. 14-18 show another embodiment of the apparatus of the present invention, designated generally by the numeral 51.

Figure 14:
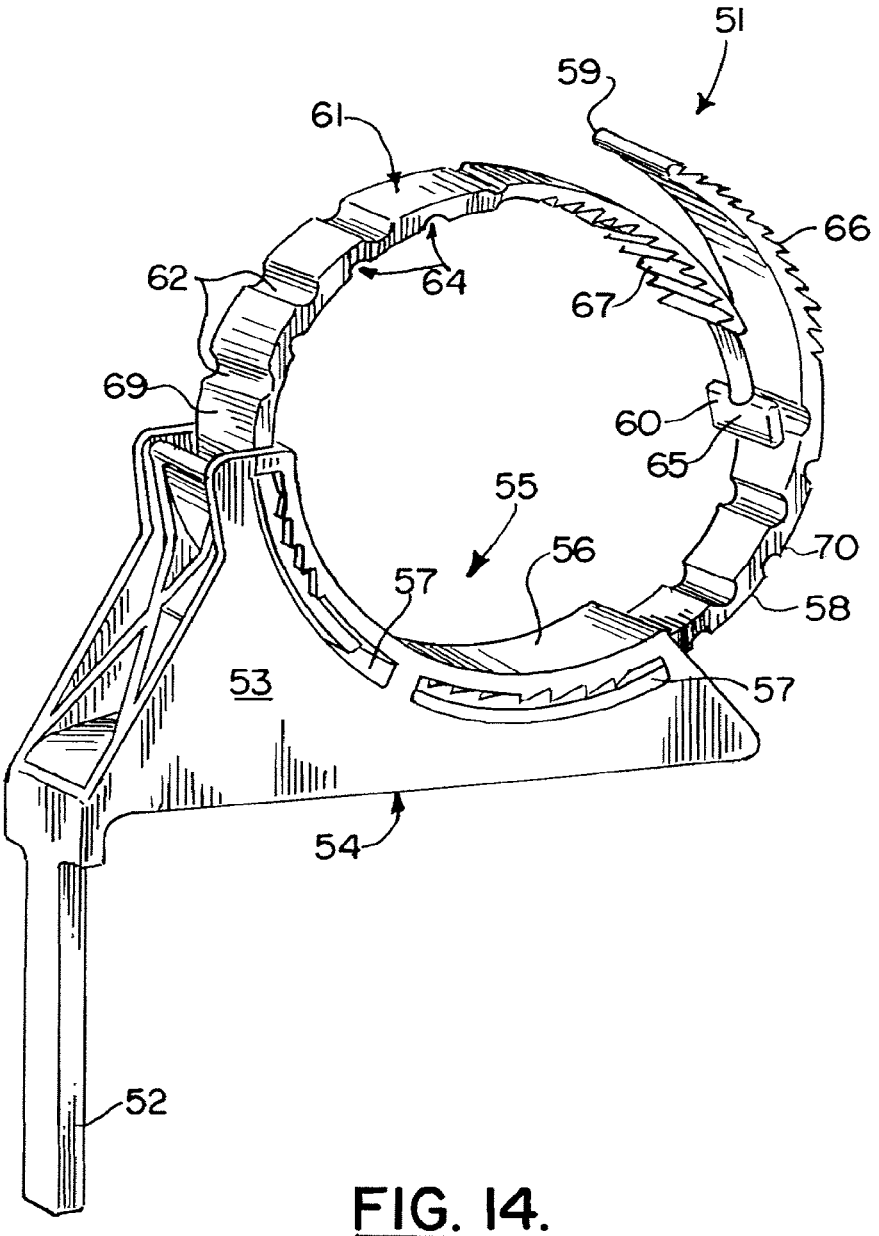
FIG. 14 is a perspective view of an alternate embodiment of the apparatus of the present invention.

Leg restraining apparatus 51 provides a vertical flange 52 that is connectable to the vertical slot 17 of body 16 using threaded set screw 19 and internally threaded opening 18 as with the embodiment of FIGS. 1-13. In FIG. 14, a cradle 53 has a flat underside that can be rested upon upper surface 12 of operating room table 11. Cradle 53 provides a concavity 55 defined by curved surface 56 of cradle 53. Cradle 53 provides a curved slot 57 that is receptive of belt 58. The belt 58 can include multiple belt sections 69, 70.

A belt free end portion 59 forms a connection with another belt free end portion 60. Outer surface 61 of each belt section 69, 70 can be provided with transverse grooves 62 for increasing belt 58 flexibility. Each belt section 69, 70 has an inner surface 63 that is generally smooth and curved as shown. However, the inner surface 63 of each belt 58 or belt section 69, 70 can also be provided with transverse grooves 64 as shown.

The belt free end portion 60 provides a handle 65 that enables a user to tighten the free end portion 60 relative to the free end portion 59. In that regard, the free end portion 59 provides upwardly facing teeth 66, while the free end portion 60 provides downwardly facing teeth 67 as shown in FIGS. 14-18. If the belt 58 is formed of multiple belt sections 69, 70, the curved slot 57 can provide teeth at 74 that form a connection with the teeth 71, 72 of the belt sections 69, 70.

Figure 15:
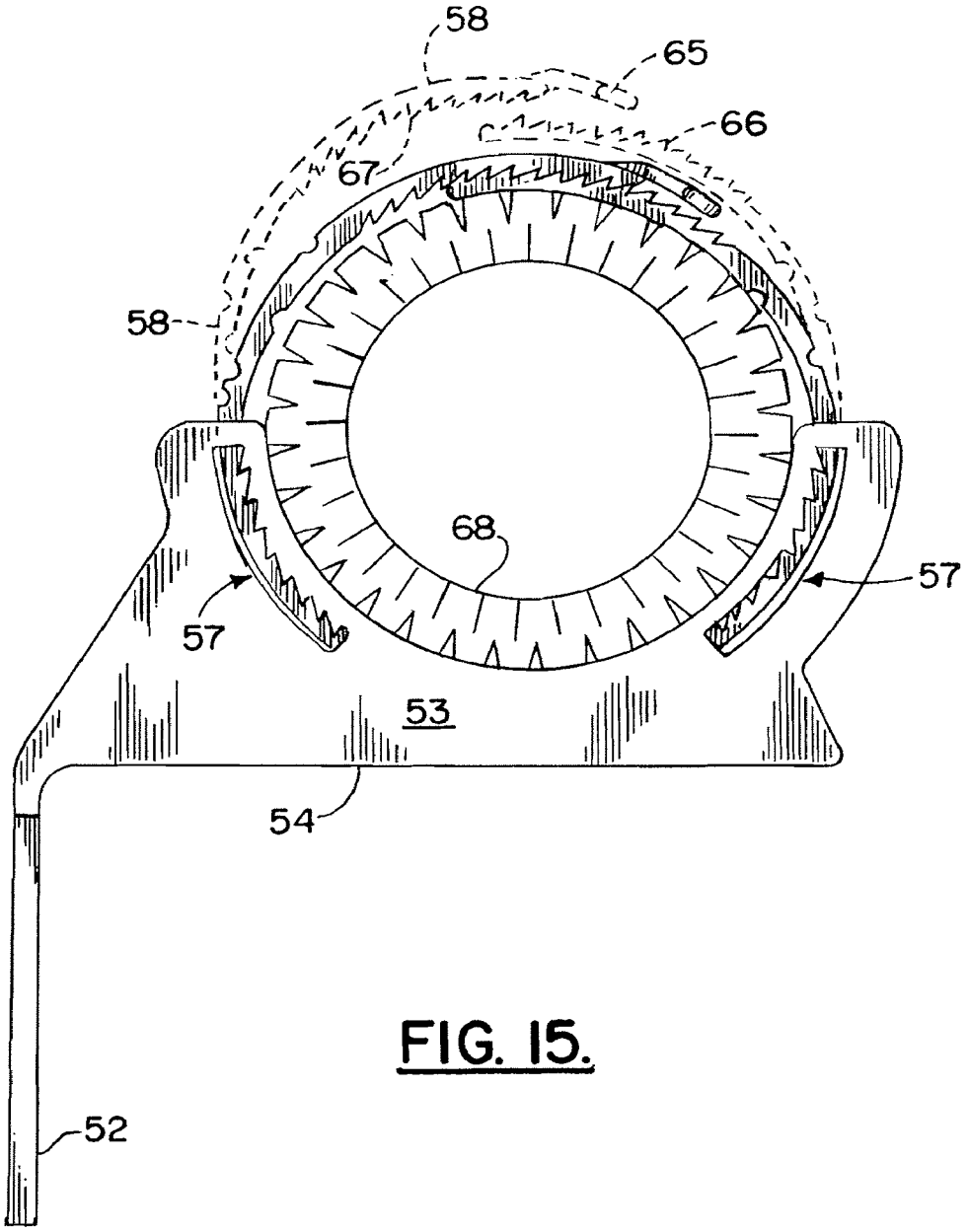
FIG. 15 is a perspective view of an alternate embodiment of the apparatus of the present invention.
Figure 16:
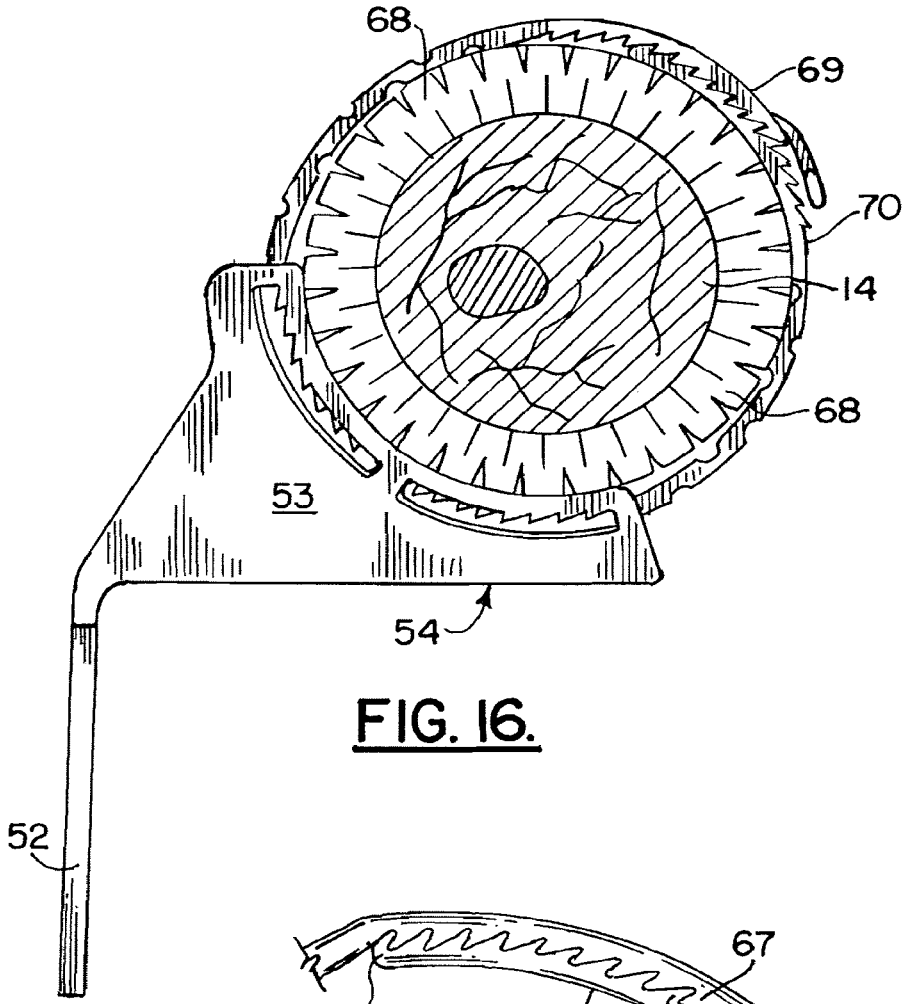
FIG. 16 is a sectional elevation view of a second embodiment of the apparatus of the present invention.
Figure 17:
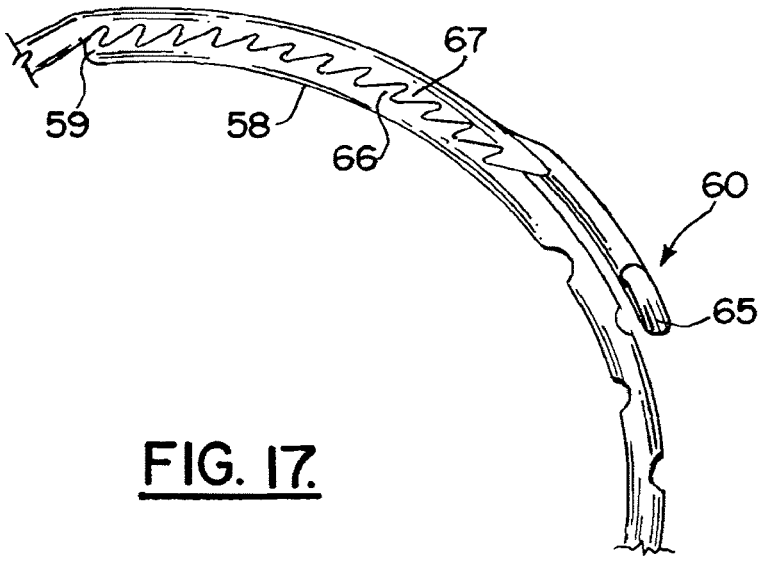
FIG. 17 is a fragmentary sectional view of a second embodiment of the apparatus of the present invention.
Figure 18:
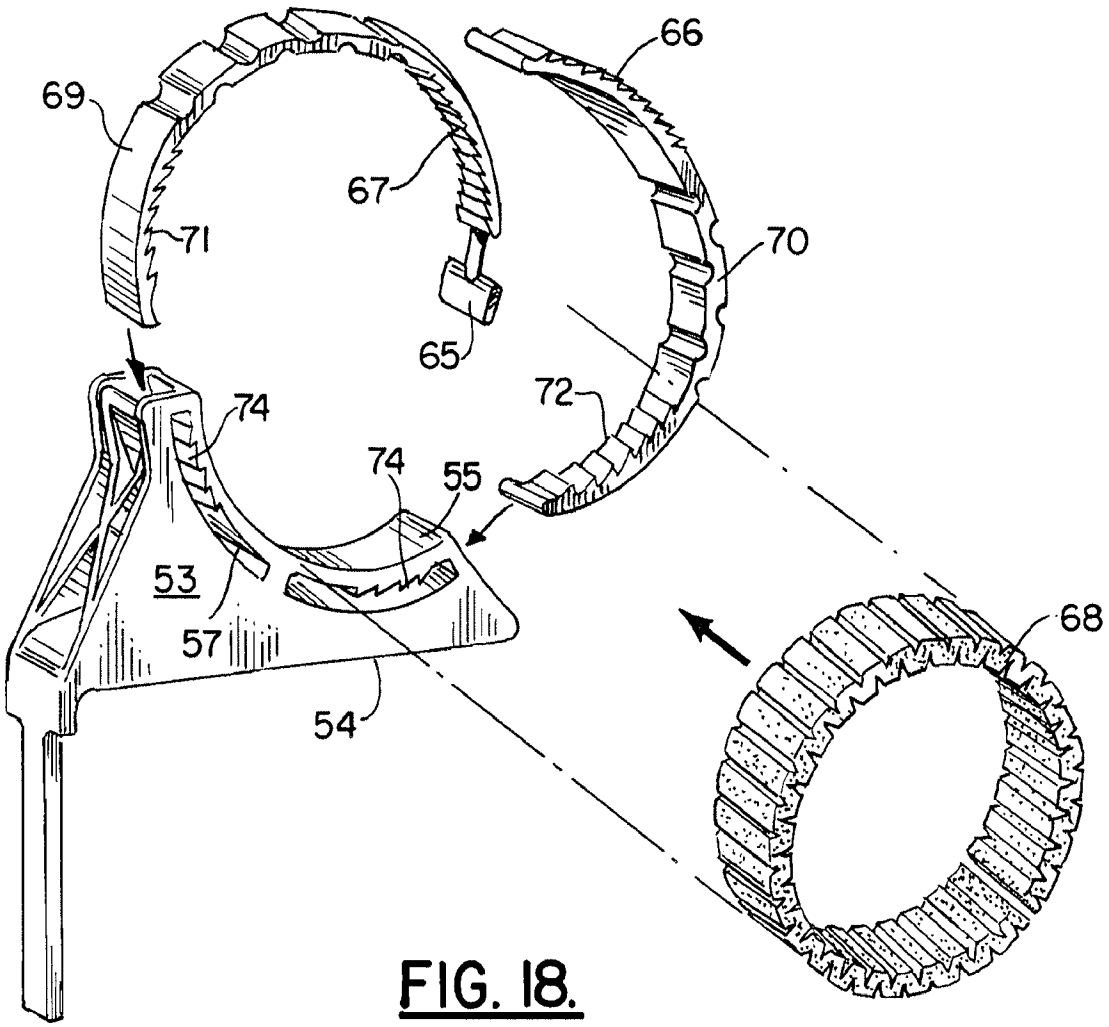
FIG. 18 is an exploded perspective view of a second embodiment of the apparatus of the present invention.

In FIGS. 15-16, the patient's leg 14 is shown secured within the belt sections 69, 70. A donut shaped pad 68 can be placed as an interface between the belt sections 69, 70 and cradle 53 and the patient's leg 14.

Figure 19:
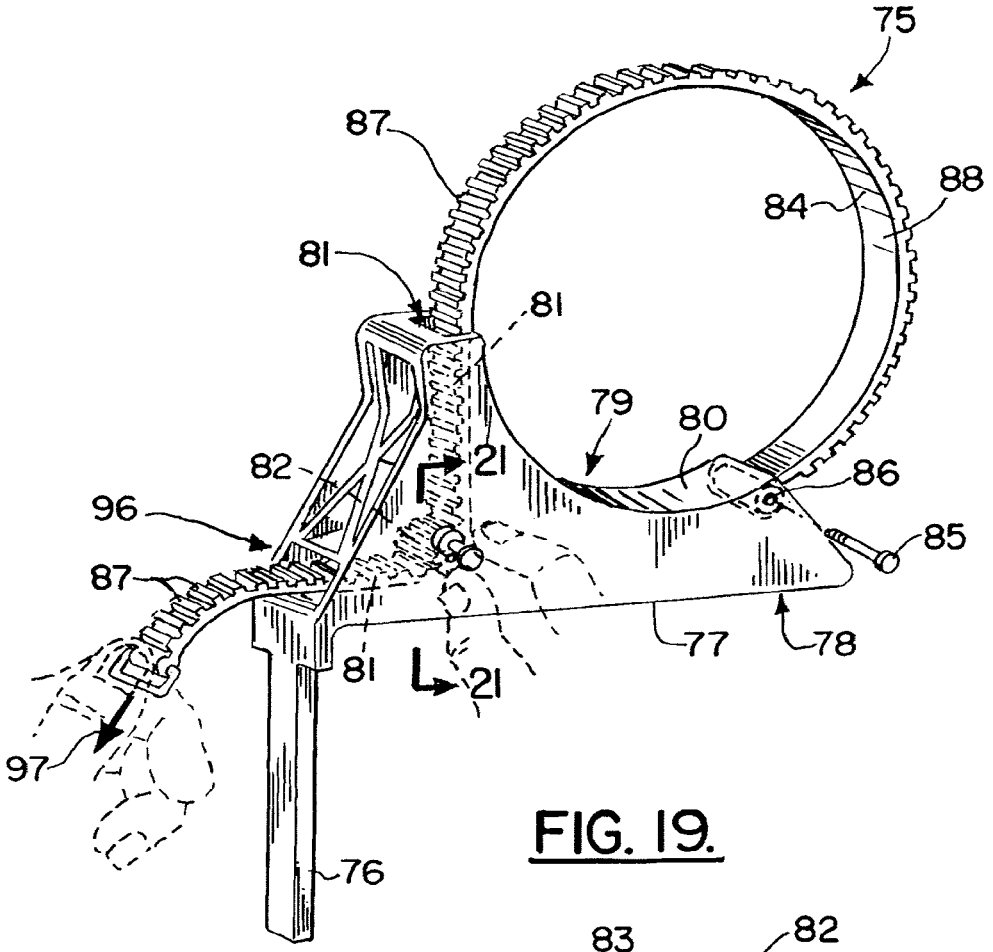
FIG. 19 is a perspective view of a third embodiment of the apparatus of the present invention.
Figure 20:
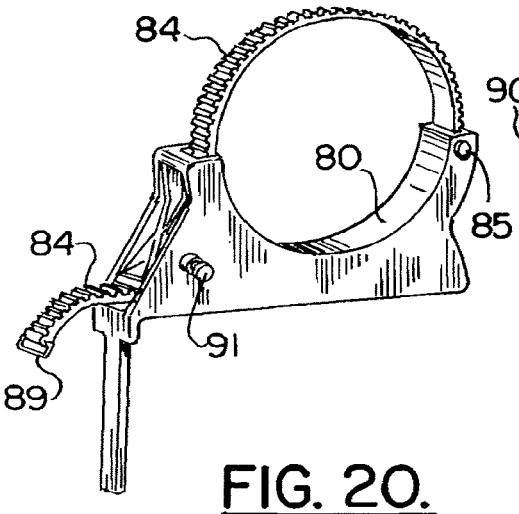
FIG. 20 is a perspective view of a third embodiment of the apparatus of the present invention.
Figure 21:
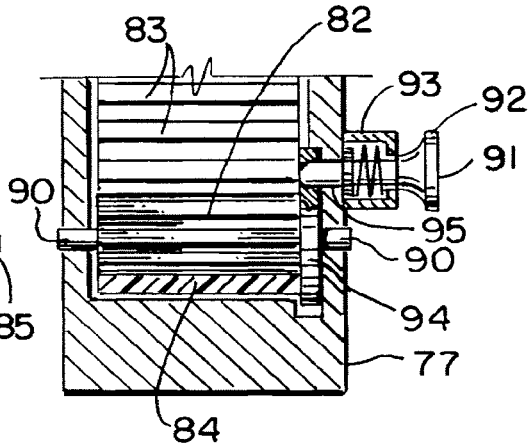
FIG. 21 is a sectional view taken along lines 21-21 of FIG. 19.

FIGS. 19-21 show another embodiment of the apparatus of the present invention. In FIGS. 19-20, leg restraining apparatus 75 provides a vertical flange 76 that is integrally attached to cradle 77. Cradle 77 provides a flat surface or underside 78 that can rest upon the operating room table 11 upper surface 12. Cradle 77 provides a concavity 79 defined by curved surface 80. The curved surface 80 can extend a full 180 degrees as shown in FIG. 20 or can be less than 180 degrees as shown in FIG. 19. An ell shaped channel 81 extends through cradle 77 as shown in FIG. 19. Channel 81 extends to pinion gear 82 and then exits via outlet 96. The free end portion of belt 84 can be gripped at d-ring 89 by a user as shown in FIG. 19, illustrated schematically by the arrow 97. Belt 84 is a toothed belt, having a toothed surface 87 that engages teeth 83 of pinion gear 82. Belt anchor pin 85 anchors belt 84 to cradle 77 as shown in FIGS. 19 and 20. Belt anchor pin 85 is secured to pin opening 86, also extending through an opening at an end portion of the belt 84.

Pinion gear 82 has a gear shaft 90 that is mounted to opposing sides of cradle 77 as shown in FIG. 21. Locking pin 91 can be used to form an interlocking connection with an opening 95 in gear plate 94 that is attached to and rotates with pinion gear 82. Locking pin 91 can provide a knob 92 and spring 93. The spring 93 normally holds the locking pin 91 in a locking position as is shown in FIG. 21. Knob 92 enables a user to pull the pin away from pinion gear 82 for unlocking the pinion gear and enabling a user to tighten the belt 84. When a user releases the knob 92, spring action provided by spring 93 thrusts the locking pin 91 back into engagement with one of the openings 95 in plate 94 of gear 82.

The embodiment of FIGS. 19-21 can also be used with a donut shaped pad 68, as is shown in FIGS. 15-16.

Figure 22:
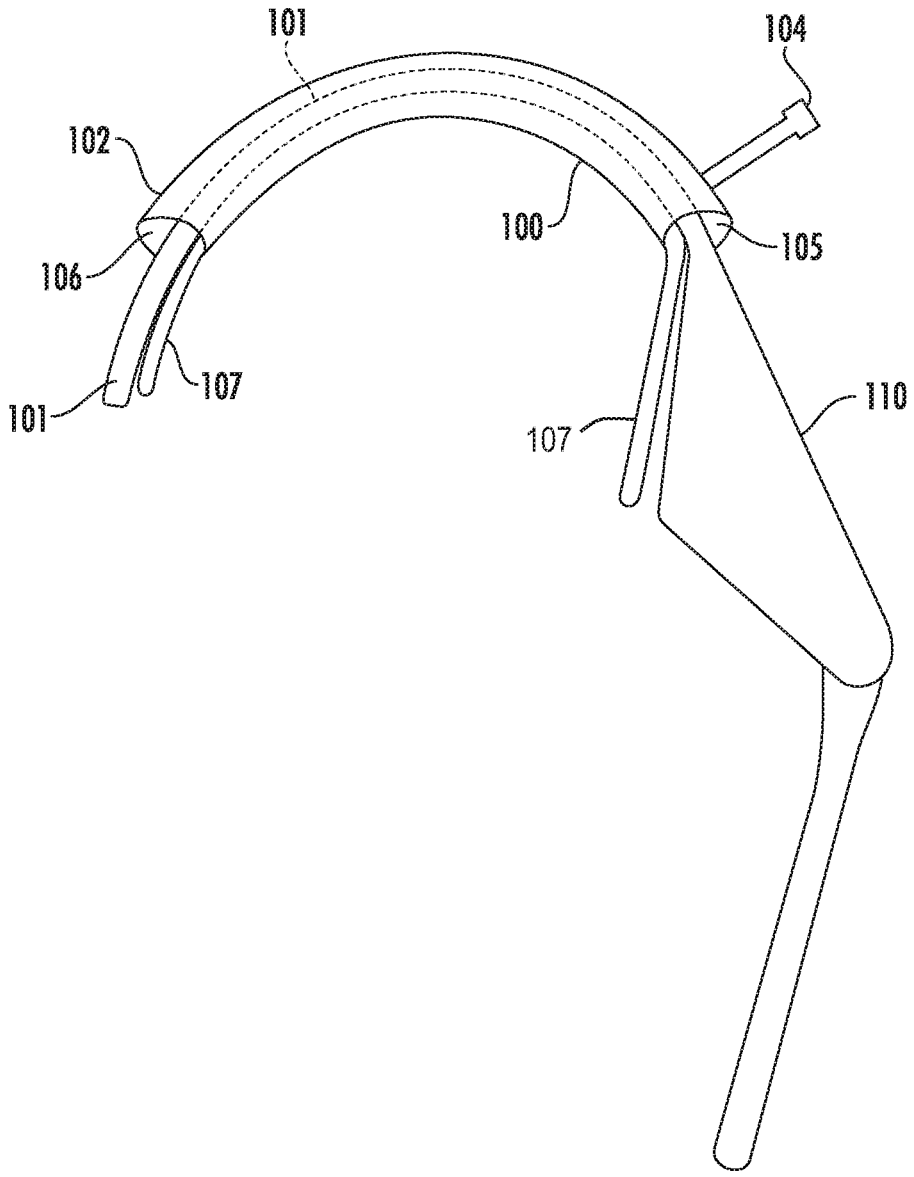
FIG. 22 is a side view of an air bladder attached to a leg restraint.
Figure 33:
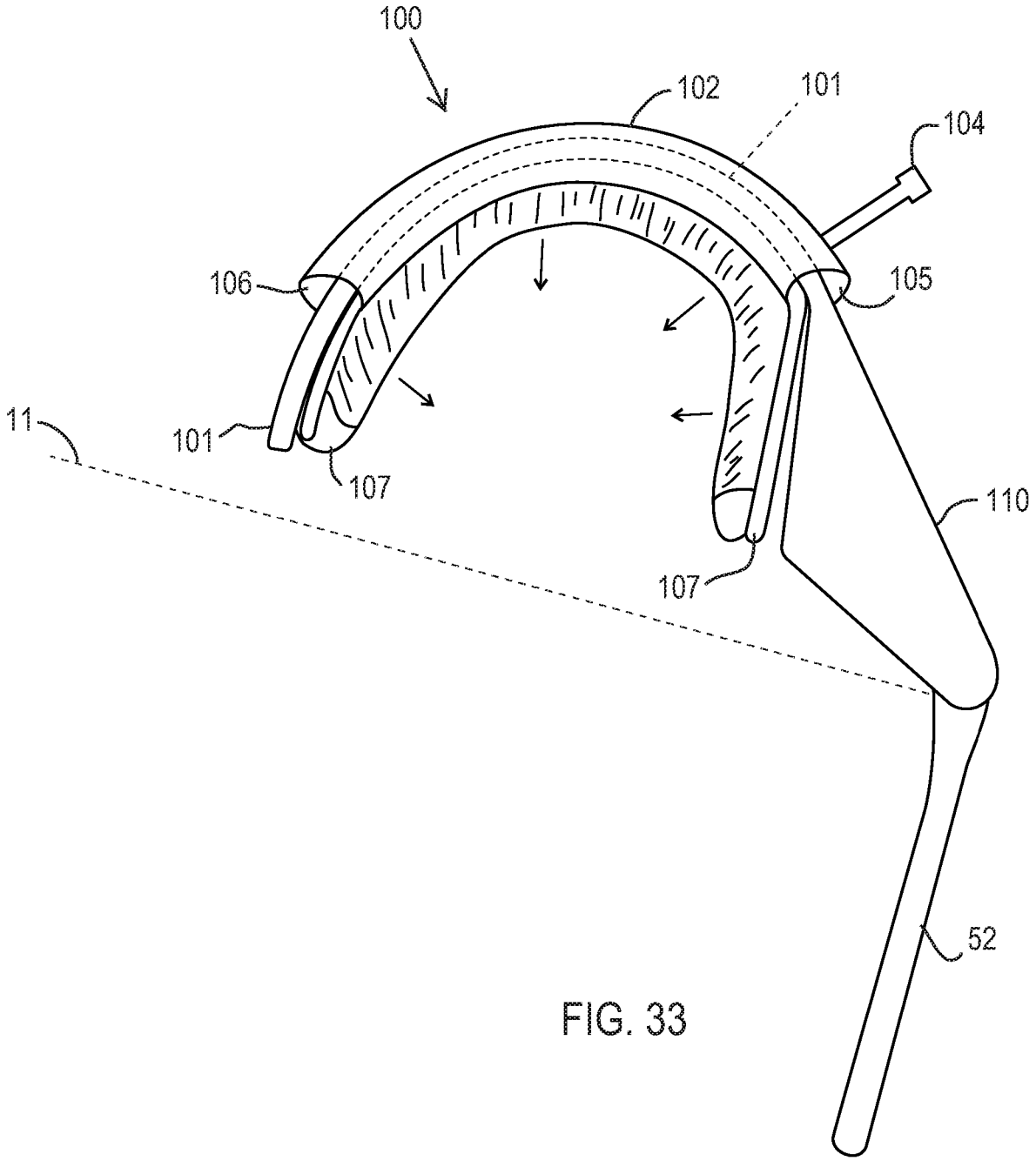
FIG. 33 is a view of an air bladder in an inflated configuration.

FIGS. 22 and 33 show another embodiment of the present invention including an air bladder 100 that can be attached to the arc 101 of an arthroscopic knee restraint 110 by threading the support arc 101 through the air bladder sleeve 102 and actual air membrane. Air bladder 100 can be made of a plastic material with an air intake hose 104 attached for the purpose of inflation and deflation of air bladder 100 as needed for surgical support during arthroscopic knee surgery with a leg restraint 110.

Air bladder 100 can be encased in an outer envelope or sleeve 102 with a slot opening 105 proximal to the air intake attachment 104 and another slot opening 106 distally close to the distal end of the air bladder housing 102. The outer envelope 102 can be of a different material from air bladder 100. The two slots 105, 106 allow for the threading of the arc 101 of leg restraint 110 to be placed into the proximal slot 105 first and threaded through to the distal slot 106, thus providing an encasing mechanism directly to leg restraint 110, and the air attachment tube 104 can be threaded through a hole provided in the leg restraint to further anchor the air bladder 100 to the leg restraint 110 (see for example FIGS. 22, 33).

The inside portion or member 107 of the air bladder 100 can cover the entire inside surface of arc 101 of the arthroscopic knee restraint 110, from its proximal point all the way to the distal end (see for example FIG. 22). This portion 107 preferably inflates, as indicated by the arrows in FIG. 33, to facilitate sizing of all patient legs to the arthroscopic knee restraint 110. The inflated portion 107 allows the brace to be used for different leg sizes. FIG. 33 shows inner portion or member 107 in an inflated configuration. The shaded area shows the envelope or member 107 inflated to preferably size a patient's leg to the brace. The use of the inflated portion 107 preferably immobilizes the leg 14 in between the inflated member 107 and the top of the operating table 11, so that surgery can be performed arthroscopically.

Bladder 100 can be held in the correct position by an air attachment tube 104 at the proximal end. The outside portion of the air bladder sleeve 102 preferably does not cover the arc 101 of the leg restraint structure fully, extending distal of the air attachment tube 104 location all the way distally to the end of the arc of the structure of the arthroscopic knee restraint 110. Air bladder sleeve 102 can include straps or sleeves to hold the inside portion 107 to the inner surface of leg restraint arc 101.

This novel method of attachment preferably allows for rapid set-up of the operative leg restraint to perform knee arthroscopy; preferably permits easy replacement of air bladders for multiple surgery procedures; and preferably allows for rapid "flash" sterilization of the leg restraint between surgical procedures. The scope and purpose of the novel air bladder attachment method is to facilitate the surgical procedure, increase efficiency and efficacy, and reduce the overall cost of performing knee arthroscopy.

The primary benefit to this novel air bladder attachment method is preferably to provide improved set-up time for operative procedures, eliminate complex attachment methods such as Velcro, and readily enable quick surgical sterilization and facilitate sterility "flash" process of the air bladder 100 and arthroscopic knee restraint 110.

In various embodiments, the air bladder 100 of the present invention can be preferably used with any leg restraint embodiment disclosed herein. Alternatively, the air bladder can be preferably used with any restraint that has an arc and a hole for the air bladder inflation and deflation; and can preferably fit other leg restraints that might be developed in the future similar to the restraint disclosed herein.

The air bladder 100 can be preferably a single use device, and disposable, so as to maintain the highest level of cleanliness.

Figure 23:
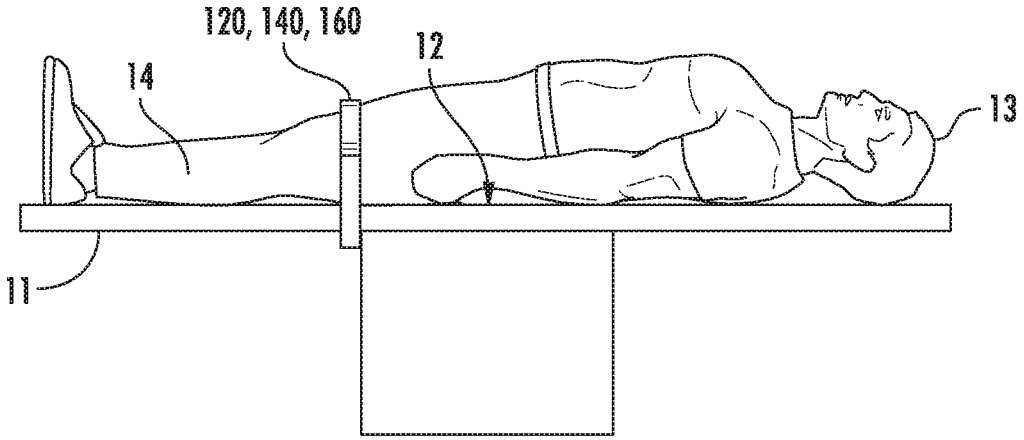
FIG. 23 is an elevation side view of an alternate embodiment of the apparatus of the present invention showing the patient's leg in an extended, horizontal position with restraint closed.
Figure 24:
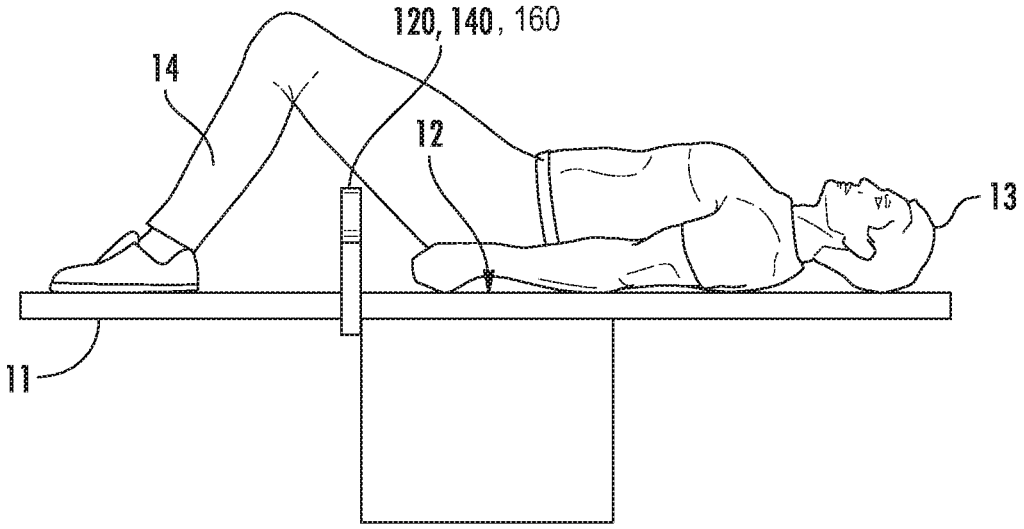
FIG. 24 is an elevation side view of an alternate embodiment of the apparatus of the present invention showing the patient's leg in a flexed 90 degree position wherein the restraint has been opened.

In another embodiment, a knee restraint device can preferably allow a surgeon to raise a knee joint post ACL repair (as many do today) thus fully covering all aspects of the knee arthroscopy surgical process (see FIG. 24). This embodiment preferably incorporates a top arc that would slide off post implant of the ACL ligament, and preferably allow the surgeon to raise the knee joint past 90 degrees, testing the implant integrity. The apparatus can be preferably useful for the surgeons that use this approach, as compared to the procedure of sitting and merely letting the lower leg flex downward to 90 degrees as previously used. The top arc break/opening feature can allow a surgeon to test the knee flexibility post ACL repair by preferably opening the top arc and flexing the knee joint about 90 degrees, while the patient is laying prone on an operating room (OR) table (see FIGS. 23-25).

The operational principle of this improved design embodiment and other embodiments is basically the same. One difference is that the improved design preferably allows for the leg to be bent at the knee about 90 degrees by opening of a top arc which can be preferably hinged and has a release push-pull button/cap on the one end, or removably connected, when operating on a horizontal plane. During regular operating room (OR) surgery, the top arc can be locked in place and holding the full circle closed. An air bladder 100 can be preferably used to provide a sizing mechanism for different leg sizes. Upon completion of surgery, especially to test a ACL repair that is being performed on a horizontal plane (the OR table is preferably flat) by a surgeon that prefers to operate standing up, the top arc can be released to allow the surgeon to flex the patients repaired knee ACL to 90 degrees, testing the new implanted and attached ACL (see FIGS. 23-25).

This same method would preferably be used when performing a meniscectomy in a horizontal position with a standing operative surgery method.

Some of the other models/embodiments show diverse methods for attaching the top arc, but essentially all perform the same tasks in the same fashion.

The device internal (inside diameter of device) diameters would preferably be about a 8 to 9-inch size, although it could change for very large legs should it be necessary. The width of the structure is the same as the original leg restraint, about 1⅞th inches, and the materials for manufacturing can preferably be polycarbonates with long strand glass fibers and/or polycarbonates with carbon fibers (new material that is much stronger).

Figure 29:
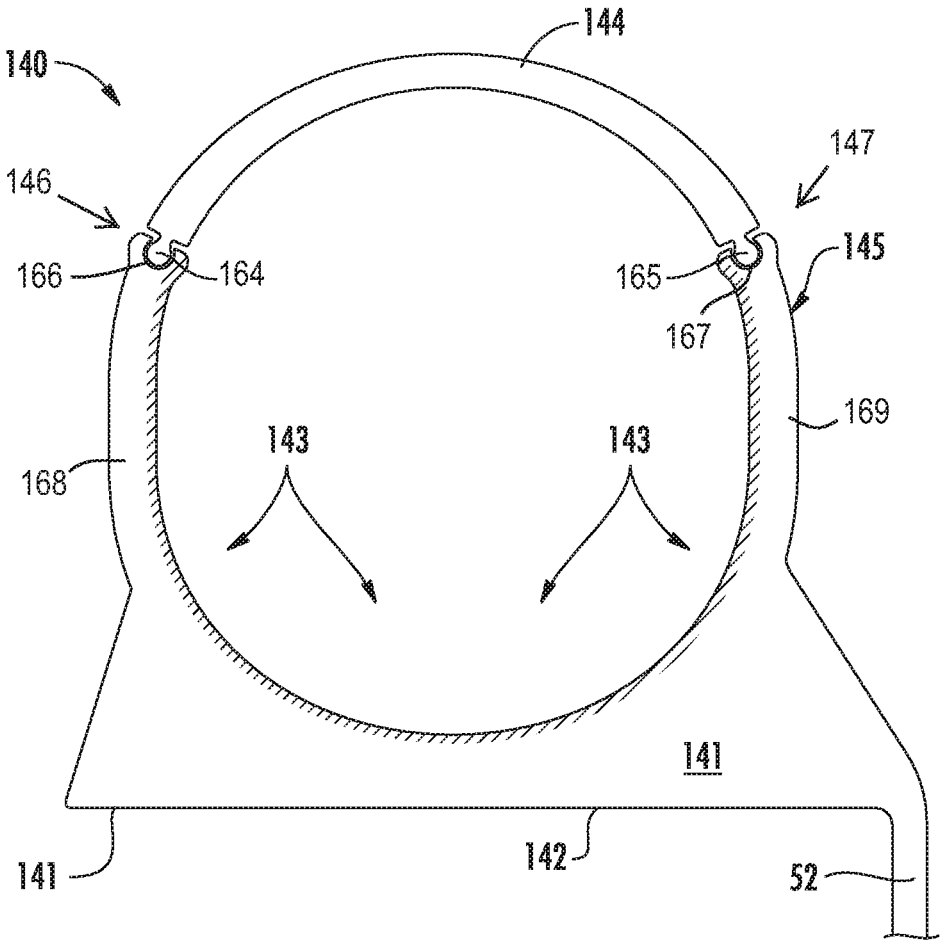
FIG. 29 is an elevation view of an alternate embodiment of the present invention wherein top arc is in the form of a sliding member or bar that slides to separate from the restraint base.
Figure 30:
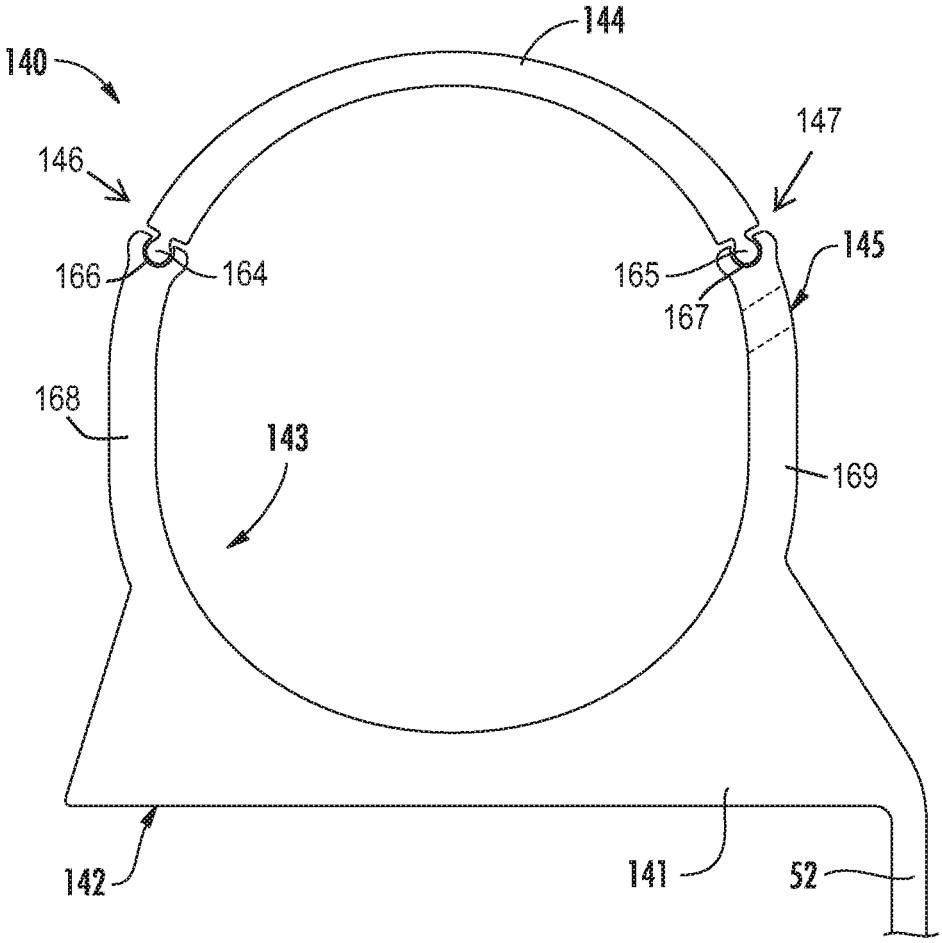
FIG. 30 is an elevation view of an alternate embodiment of the present invention wherein the top arc is in the form of a sliding member or bar that slides to separate from the restraint base.

In one embodiment, a top arc can be preferably capable of sliding off during surgery for this crucial test, and then preferably replaced again should further intervention be required. The attachment can be preferably via ball point on the arc, for example, and a corresponding slot in the leg restraint support arms on both sides, as seen in FIGS. 29-30. The major pressure point can be preferably on either lateral support, for example, and less towards the top and/or upward pressure.

The edges of the structure/support arms can be preferably rounded on both sides in order to increase patient safety and comfort while the surgeon manipulates the leg/knee joint during surgery. The device can preferably employ a similar air bladder 100 as previously used as well to better size patient's thighs.

In an embodiment of the leg restraint, two sliding locks can be preferably used to hold the top arc in place during surgery. The top arc can be preferably opened up to allow the surgeon to operate on a horizontal OR table set-up, and flex the knee joint upwards following ACL repair to test the integrity of the new ACL ligament following attachment. This embodiment may also be used by those surgeons that prefer to operate standing up on a flat OR table rather than seated. The materials are similar, although today there are some new versions that incorporate carbon fibers that make the material substantially stronger and more rigid that the other polycarbonate material (EMS Grivory 7H).

In an embodiment, the final approach to testing the knee is by flexing it upward from a flat OR Table versus one with the end at 90 degrees plus. The advantage is for those performing ACL repairs on a flat OR Table (horizontal) and having the ease of swinging the upper arc out of the way to perform the "flex" test after attaching a new ACL. This system versus the current ones is much easier, self-contained without having to remove any parts, and readily locks back in place should it be required to continue the surgical repair. Also, it is extremely light weight, easy to operate, and has all the properties of a SS device (strength and rigidity) without the cumbersome aspects of a heavy and robust device.

Various embodiments can be preferably manufactured with carbon fiber polycarbonates, for example, resulting in weight loss and increased strength and rigidity, upping the benefits and features of this model. The material can preferably include polycarbonate with long glass fibers and polycarbonates with carbon fibers, which is new material much stronger than existing glass fiber material.

Figure 25:
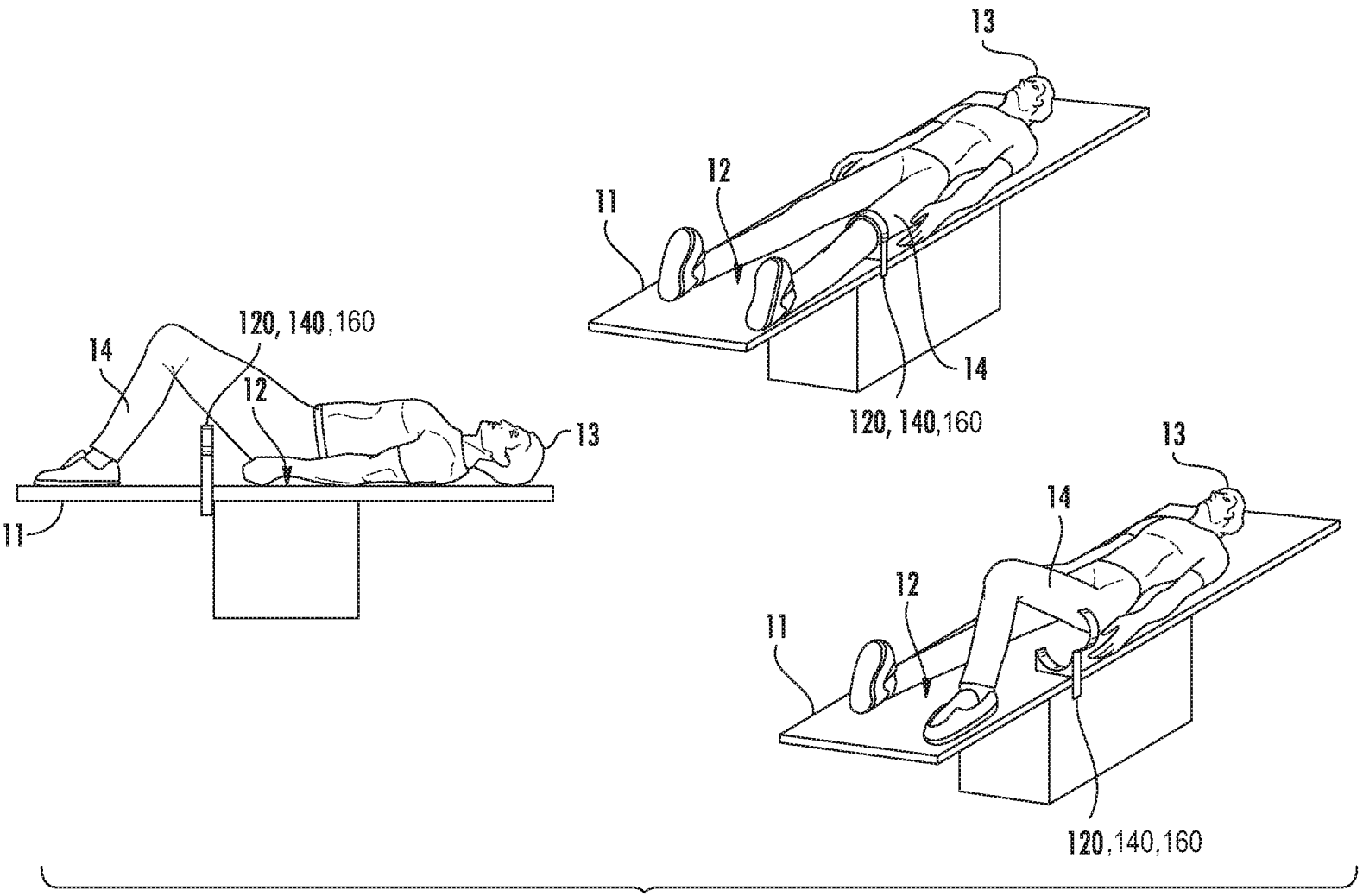
FIG. 25 is a schematic diagram of an alternate embodiment of FIGS. 23-24 showing patient prone on table, patient with top arc opened and patient with leg flexed about 90 degrees.

FIGS. 23-32 show various embodiments of the apparatus of the present invention. In FIGS. 23-25 there can be seen an operating room table 11 with a patient 13 preferably lying on the upper surface 12 of the table 11. This arrangement of patient 13 and table 11 can be an arrangement suitable for certain leg surgery procedures such as anterior cruciate ligament or ACL repair. In FIG. 23, the patient 13 has a leg 14 that is secured with clamp apparatus 120, 140, or 160.

The embodiments seen in FIGS. 23-32 can weigh between 1 and 2 pounds, more preferably between 1.5 and 2 pounds, and most preferably about 2 pounds. The embodiments seen in FIGS. 23-32 are preferably molded of polycarbonates with long strand glass fibers, and/or carbon fibers for maximum strength, rigidity, and structural integrity.

In FIG. 23, the patient 13 is in a prone position on the operating room table 11 upper surface 12 with legs 14 outstretched. The patient's leg 14 is preferably secured in restraint 120, 140 or 160. In FIG. 24, the clamp apparatus 120, 140, 160 has been opened or moved to an open position (see for example FIG. 26). The patient's leg 14 is flexed about 90 degrees. The open position of the apparatus preferably allows a surgeon to flex the patient's leg 14 about 90 degrees to check the ACL repair.

FIG. 25 is a schematic diagram, similar to embodiments of FIGS. 23-24, showing patient 13 prone on table 11, patient 13 with top arc opened and patient 13 with leg 14 flexed about 90 degrees.

Figure 26:
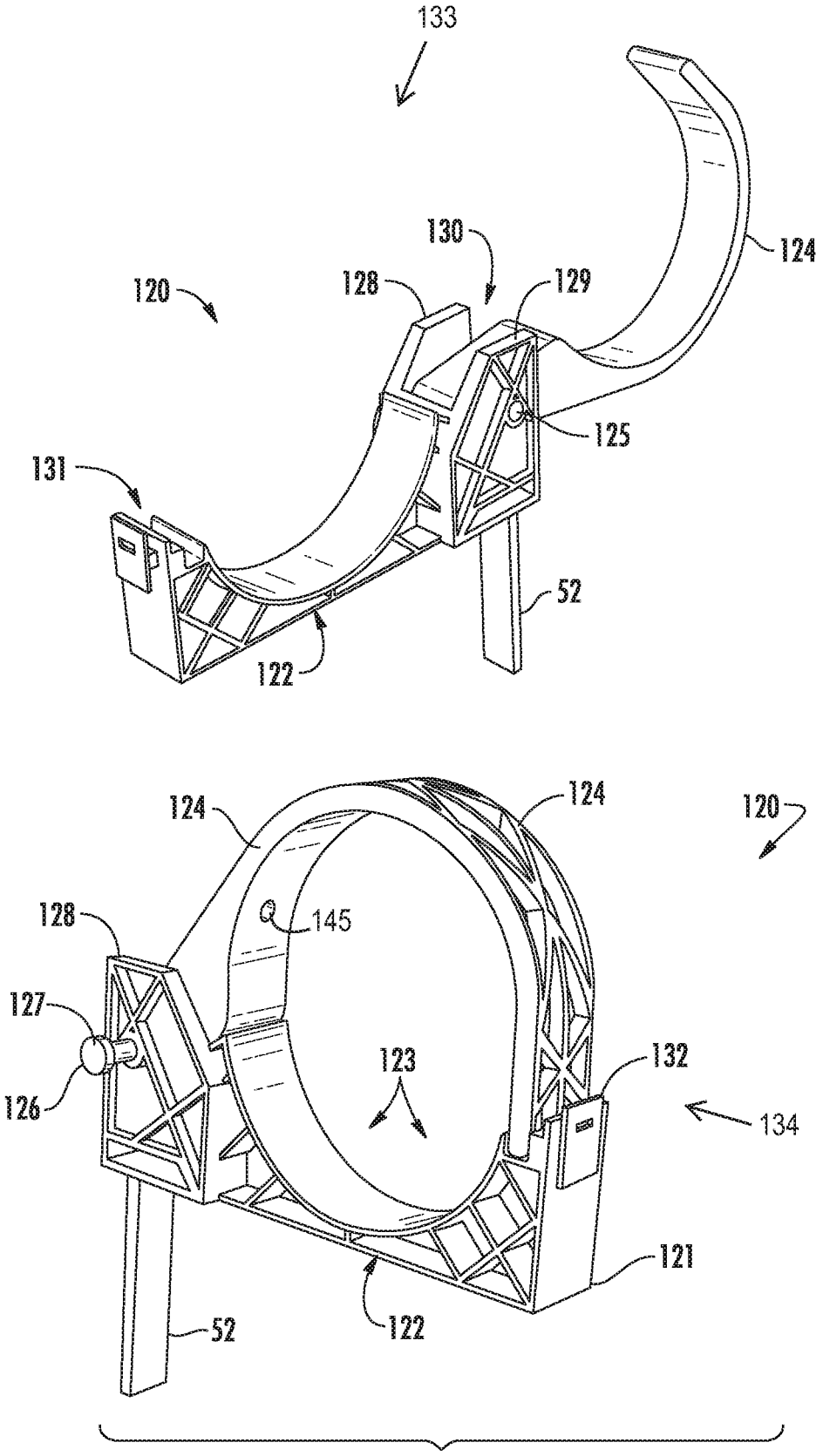
FIGS. 26-27 are perspective views of an alternate embodiment of FIGS. 23-25.
Figure 27:
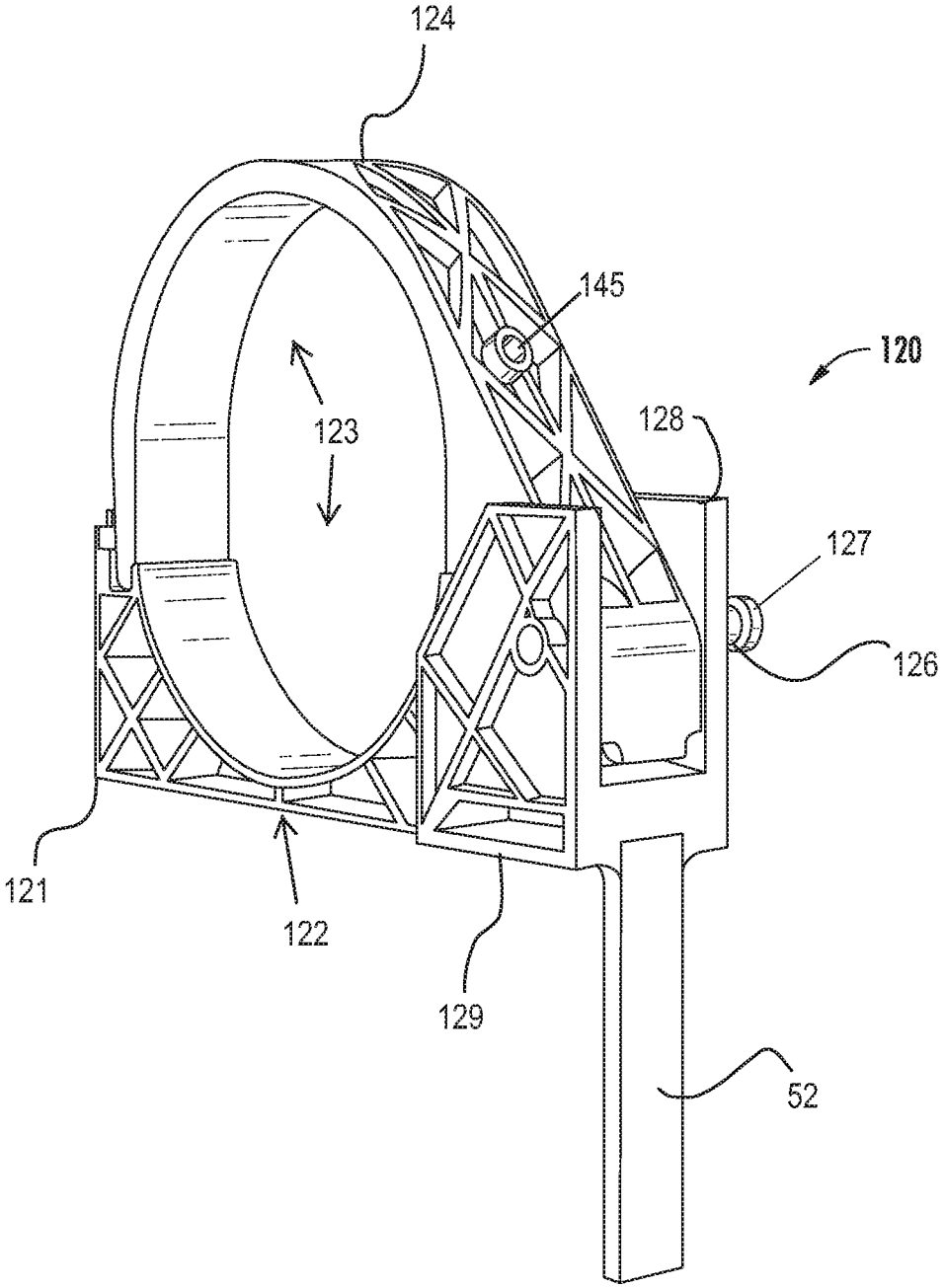
Figure 28:
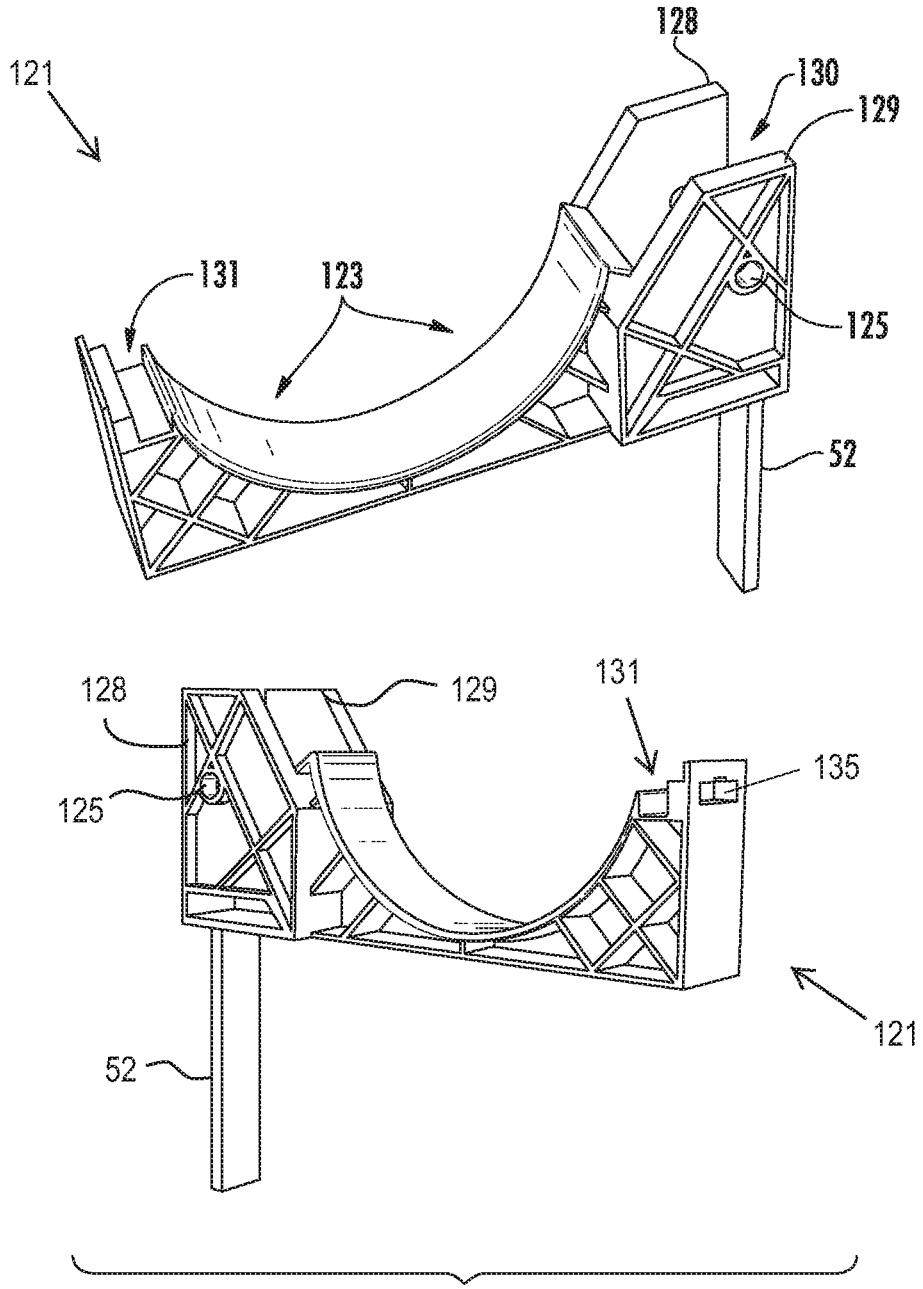
FIG. 28 is a perspective view of an alternate embodiment of the apparatus of the present invention showing the bottom section of the device.

FIGS. 26-28 show leg restraint apparatus 120 in more detail. The restraint apparatus 120 preferably has a cradle or base 121 with flat underside 122 that preferably engages upper surface 12 of table 11 during use. Cradle or base 121 preferably has a concave portion or concavity 123 that preferably cradles the patient's leg 14. Top arc 124 can be preferably pivotally connected to cradle or base 121 at pivot or pivotal connection 125. Pivot or pivotal connection 125 can preferably utilize a pin or removable pin 126 having head 127. Pin 126 can be preferably removed from base 121 to preferably allow complete removal of arc 124, as seen in FIG. 28.

Top arc 124 can be preferably pivotally attached to the cradle or base 121. The patient's leg 12 can be confined with the base/cradle 121 and top arc 124, wherein the top arc 124 preferably covers the top and part of the sides of the patient's leg 14, but does not engage the underside of the patient's leg 14. The cradle or base 121 can preferably be placed under but does not encircle the patient's leg 14. The top arc 124 can be opened or closed to selectively restrain or enable release of the patient's leg such as when a surgeon wants to flex the leg after knee surgery on the patient.

The dimensions (diameter) horizontally of the interior of restraint apparatus 120 are preferably made up by concavity 123 and top arc 124, and can be preferably about 8-9 inches and the vertical diameter dimension can be preferably about 8-9 inches, which preferably accommodates preferably about 95% of legs being operated on today. An air bladder can be preferably used and can act in a manner to secure the leg by sizing the leg to the brace so that it is held firmly in place.

Base or cradle 121 preferably has a pair of spaced apart flanges 128, 129 preferably opposite pivot 125 with a recess 130 between the flanges. The distance between flange 128 to flange 129 can be about 2 inches. These flanges 128, 129 are preferably on opposing sides of top arc 124 and preferably provide rigidity to the apparatus 120 during use.

Latch 132 preferably enables closure of top arc 124 in recess 131 when top arc 124 moves from the open position 133 to the closed position 134 (FIGS. 26, 27). Opening 135 preferably allows latch 132 to be attached to base or cradle 121 in order to secure arc 124 in place.

An air bladder can be preferably used on apparatus 120 with including an opening 163 for placement on the opposite side of the inflation port.

Another embodiment of the leg restraint apparatus is designated generally by the numeral 140 in FIGS. 29-30. Restraint apparatus 140 preferably has a base or cradle 141 with a flat underside 142 that preferably rests upon upper surface 12 of operating room table 11. Base or cradle 141 preferably has a concave position or concavity 143. Top arc/top sliding bar 144 preferably connects to base/cradle 141 with spaced apart connections 146, 147. Each connection 146, 147 can be a ball and socket/sliding connection enabling separation of the top arc/bar from base or cradle 141 by sliding the arc longitudinally such as toward the patient's head or toward the patient's feet. Base/cradle 141 can preferably have an air connector hole 145 for an air bladder attachment.

Top arc 144 can preferably slide on and affix to base 141 preferably via a ball joint 164, 165 sliding into an oval cavity 166, 167 of similar dimensions with enough play to allow for smooth horizontal movement on and off. The top arc attachment can be preferably via ball point 164, 165 on the arc 144, and preferably a corresponding slot 166, 167 in the leg restraint support arms 168, 169 on both sides, as seen in FIGS. 29, 30. The major pressure point can preferably be on either lateral support 168, 169, and less towards the top and/or upward pressure. The edges of the structure/support arms 168, 169 can be preferably rounded on both sides in order to increase patient safety and comfort while the surgeon manipulates the leg/knee joint during surgery. Leg restraint 140 can preferably employ a similar air bladder as the other embodiments as well to better size a patient's thigh/leg.

Figure 31:
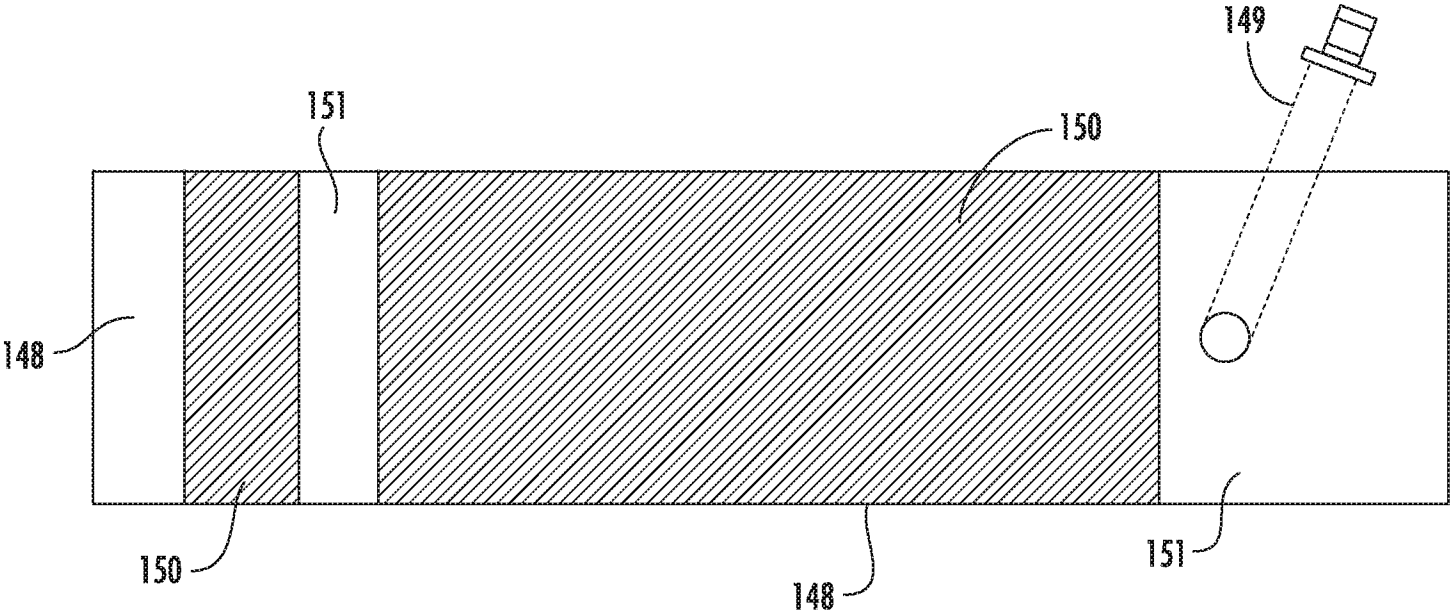
FIG. 31 is a schematic view of an air bladder that is preferably connectable to the restraint apparatus of FIGS. 23-30.

In FIG. 31, a dispersible air bladder 148 can be provided that can preferably be fastened to either base or cradle 121, 141 or to top arc 124, 144 or to both. Air bladder 148 preferably has inflation hose 149 that can be inserted through an air connector hole 145 in base/cradle 121 or 141 or to top arc 124, 144 or to both. Air bladder 148 can have sleeve parts 150 and open areas 151. The leg restraint apparatus embodiments can be used either with an air bladder sleeve, or a foam sleeve surrounding the leg.

Figure 32:
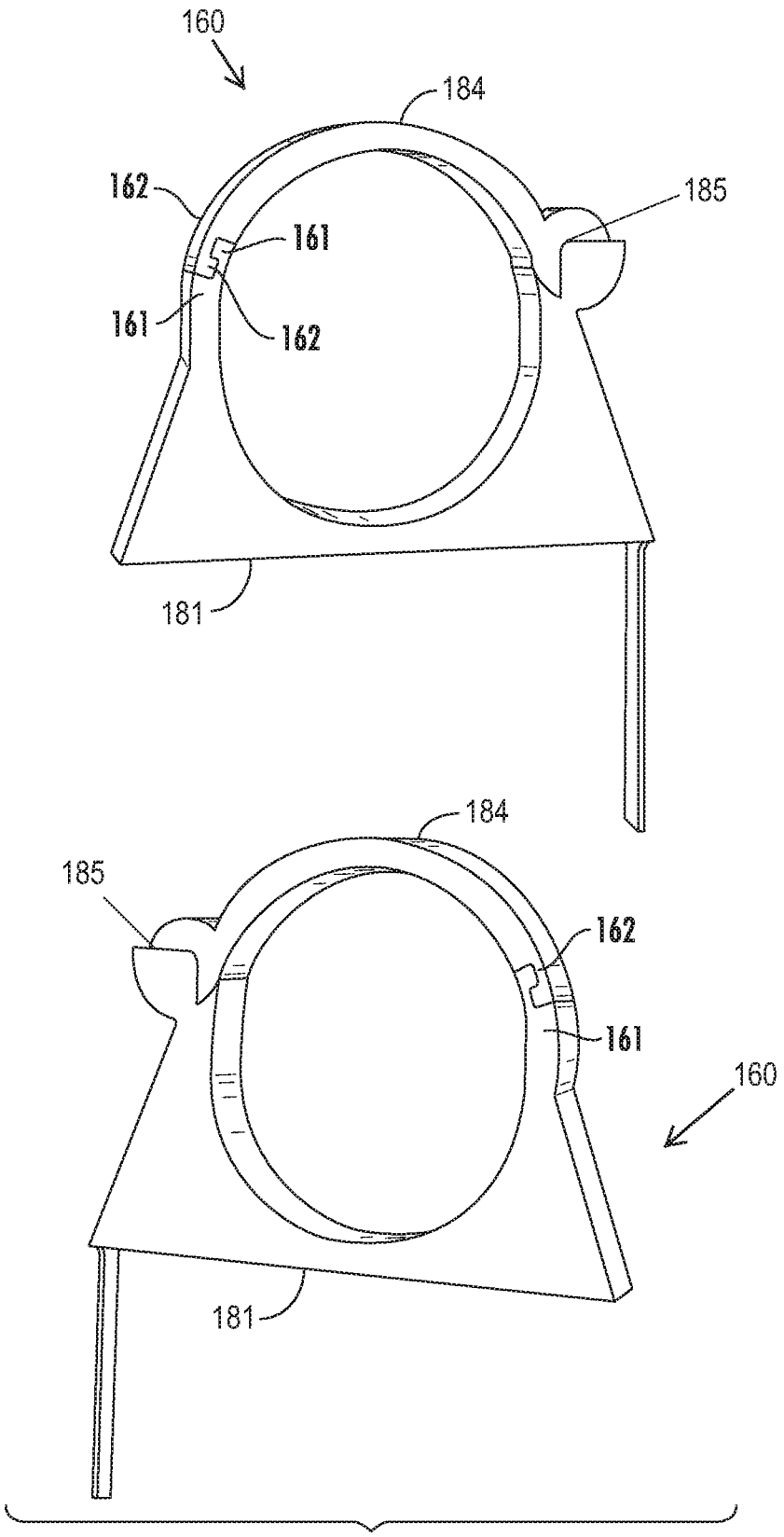
FIG. 32 is a perspective view showing another embodiment of the apparatus of the present invention.
Figure 34:
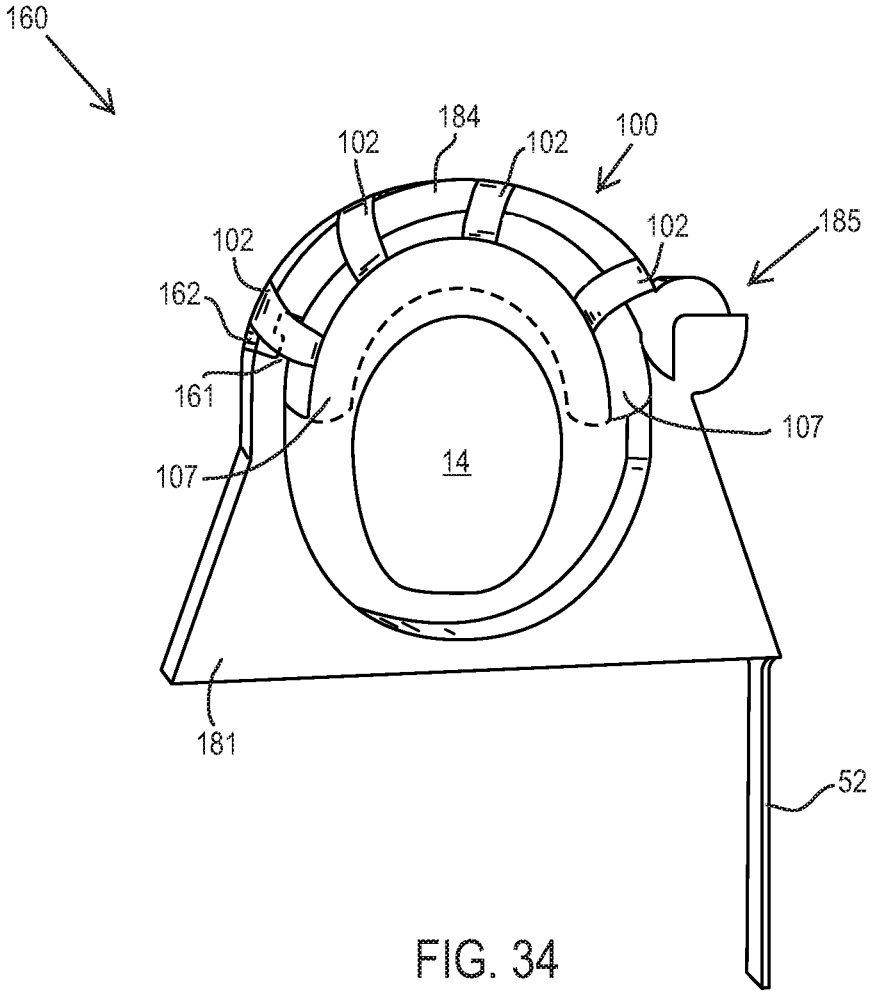
FIG. 34 is a view of an air bladder attached to another embodiment of the apparatus of the present invention.

FIGS. 32 and 34 show another embodiment of the present invention showing a latch arrangement apparatus 160 wherein top arc 184 and cradle or base 181 have interlocking portions 161, 162. Top arc 184 seen in FIGS. 32, 34 can be preferably pivotally connected to cradle or base 181 at pivot or pivotal connection 185. Interlocking portions 161, 162 connect together and preferably secure the arc 184 to base 181.

Top arc 184 can be preferably pivotally attached to the cradle or base 181 at attachment connection 185. A patient's leg 14 can be confined with the base/cradle 181 and top arc 184, wherein the top arc 184 preferably covers the top and part of the sides of the patient's leg 14, but does not engage the underside of the patient's leg 14. The cradle or base 181 can preferably be placed under but does not encircle the patient's leg 14. The top arc 184 can be opened or closed to selectively restrain or enable release of the patient's leg 14 such as when a surgeon wants to flex the leg after knee surgery on the patient.

Air bladder 100 can be attached to apparatus 160 as seen in FIG. 34. Sleeves or straps 102 can be used to hold inner member 107 to the inside portion of arc 184 or both arc 184 and base 181. The inner portion or member 107 allows the brace 160 to be used for different leg sizes. FIG. 34 shows inner portion or member 107 in an inflated configuration in dotted lines. The use of the inflated portion 107 preferably immobilizes the leg 14 in between the inflated member 107 and base portion 181, so that surgery can be performed arthroscopically.

FIG. 27 shows structural struts of the leg restraint apparatus and the structural design of the leg restraint, which enhances strength and rigidity to the entire apparatus when used during surgery. The vertical portion/flange 52 can be about 1 3/16 inches wide and about 5/16 inches thick. The distance between flange 128 to flange 129 or base 121 can be about 2 inches.

The embodiments of the leg restraint of the present invention are an innovative advantage in supporting the surgeon and patient during arthroscopic knee procedures. The system preferably includes: leg restraint device, air bladder, and operating room rail clamp, with no moving parts, extremely light weight, and easy to use.

The embodiments of the leg restraint are designed as a unique mechanical surgical assistance device to preferably support the distal thigh and preferably allow full manipulation and stressing of the knee joint during arthroscopy and arthroscopic surgery. The apparatus can be made of a unique polycarbonate material, and a separate disposable air bladder preferably connects to standard tourniquet inflation devices (150 mmHg).

The apparatus can be readily draped out of the sterile field due to its trim and conforming design, and preferably does not restrict surgical approach to the knee joint.

A patient should preferably be positioned so that the patella is placed just distal to the knee break on the operating room table. A folded blanket can preferably be placed under the knee joint for added padding, if so needed. Routine preparation procedures are performed.

Following prep, the tourniquet is preferably placed over the thigh proximal to the knee break; after which the leg restraint apparatus preferably with an attached air bladder, is placed over the tourniquet (the arc of the brace preferably encircles the tourniquet and the stem of the leg restraint is threaded thru the operating room table rail clamp provided with the device). The leg restraint apparatus is preferably pushed downward tightly, and the rail clamp is preferably engaged accordingly. Both the tourniquet and air bladder are preferably connected to air supply monitors/consoles. The air bladder can be inflated to not exceed 150 mmHg. The air bladder preferably acts as a sizing mechanism for patients with small leg diameters. The patient's leg is then preferably sterile draped.

The knee portion of the operating room table is preferably flexed beyond 90 degrees; allowing the surgeon to come forward and sit at the end of the extremity. By placing the distal foot on either side of the surgeon, the surgeon preferably has complete control over the amount of vargus or valgus stress applied to the knee joint.

Figure 4:
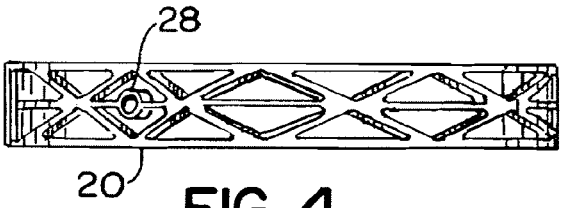
FIG. 4 is a top view taken along lines 4-4 of FIG. 1.
Figure 5:
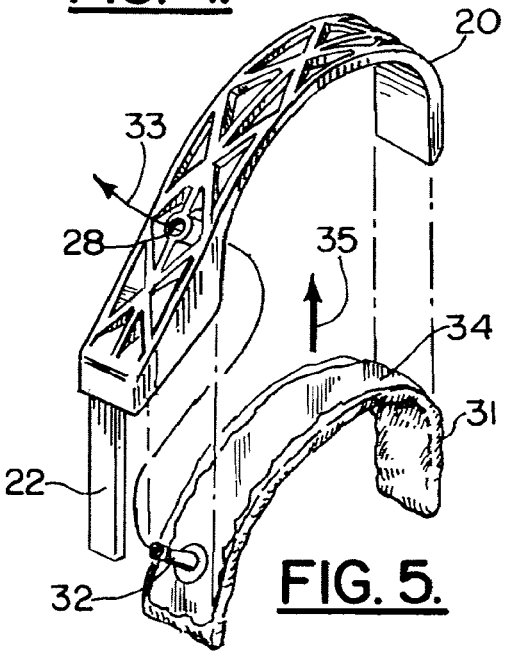
FIG. 5 is a partial perspective view of an embodiment of the apparatus of the present invention.
Figure 6:
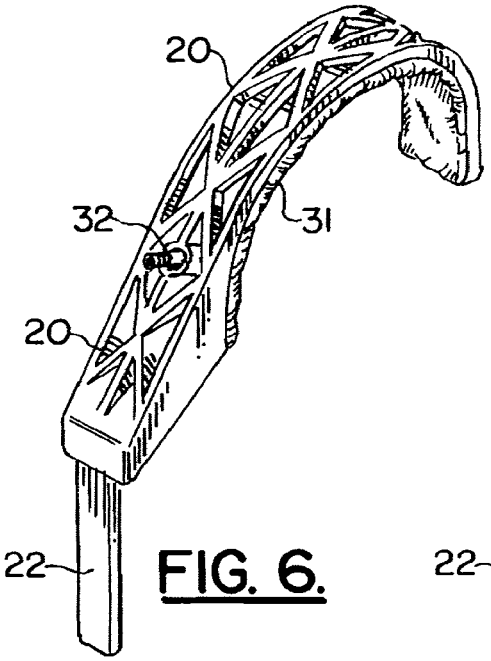
FIG. 6 is a partial perspective view of an embodiment of the apparatus of the present invention.

Clinical experience to date has indicated marked ease of use as compared to other leg restraints and/or FIG. 4 techniques, reduced operative time, and resulted in increased comfort to both the patient and surgeon. The apparatus of the present invention is a safe, simple, and successful arthroscopy technique.

The following is a list of parts and materials suitable for use in the present invention.

PARTS LIST

| Part Number | Description |
|---|---|
| 10 | leg restraint apparatus |
| 11 | operating room table |
| 12 | upper surface |
| 13 | patient |
| 14 | leg |
| 15 | locking mechanism |
| 16 | body |
| 17 | vertical slot |
| 18 | internally threaded opening |
| 19 | threaded set screw |
| 20 | restraining member |
| 20A | restraining member |
| 20B | restraining member |
| 21 | curved section |
| 22 | vertical flange/mounting flange |
| 22a | inner surface |
| 22b | outer surface |
| 23 | thickened section |
| 23a | surface |
| 23b | surface |
| 23c | surface |
| 24 | upper surface |
| 25 | longitudinal web |
| 26 | diagonal web |
| 27 | lower surface |
| 28 | opening |
| 29 | side |
| 30 | side |
| 31 | inflatable bladder |
| 32 | valve |
| 33 | arrow |
| 34 | adhesive |
| 35 | arrow |
| 36 | hook fastener |
| 37 | loop fastener |
| 38 | arrow |
| 39 | connection |
| 40 | flanged member |
| 41 | opening |
| 42 | bolt |
| 43 | opening |
| 44 | nut |
| 45 | flange |
| 46 | flange |
| 47 | slot |
| 48 | leg cradle |

-continued

PARTS LIST

| Part Number | Description |
|---|---|
| 49 | projection |
| 50 | socket |
| 51 | leg restraining apparatus |
| 52 | vertical flange |
| 53 | cradle |
| 54 | flat underside |
| 55 | concavity |
| 56 | curved surface |
| 57 | curved slot |
| 58 | belt |
| 59 | free end portion |
| 60 | free end portion |
| 61 | outer surface |
| 62 | transverse groove |
| 63 | inner surface |
| 64 | transverse groove |
| 65 | handle |
| 66 | teeth |
| 67 | teeth |
| 68 | pad |
| 69 | belt section |
| 70 | belt section |
| 71 | teeth |
| 72 | teeth |
| 73 | opening |
| 74 | teeth |
| 75 | leg restraining apparatus |
| 76 | vertical flange |
| 77 | cradle |
| 78 | flat underside |
| 79 | concavity |
| 80 | curved surface |
| 81 | ell shaped channel |
| 82 | pinion gear |
| 83 | tooth |
| 84 | belt |
| 85 | belt anchor pin |
| 86 | pin opening |
| 87 | toothed surface |
| 88 | smooth surface |
| 89 | d-ring |
| 90 | gear shaft |
| 91 | locking pin |
| 92 | knob |
| 93 | spring |
| 94 | gear plate |
| 95 | opening |
| 96 | outlet |
| 97 | arrow |
| 100 | air bladder |
| 101 | support arc |
| 102 | sleeve/envelope/housing/strap |
| 103 | air membrane |
| 104 | intake hose |
| 105 | slot/opening |
| 106 | slot/opening |
| 107 | air bladder inner portion |
| 110 | leg restraint |
| 120 | leg restraint apparatus |
| 121 | cradle/base |
| 122 | flat underside |
| 123 | concavity/concave portion |
| 124 | top arc |
| 125 | pivot/pivotal connection |
| 126 | pin/removable pin |
| 127 | head |
| 128 | flange |
| 129 | flange |
| 130 | recess |
| 131 | recess |
| 132 | latch |
| 133 | open position |
| 134 | closed position |
| 135 | opening |
| 140 | leg restraint apparatus |

-continued

PARTS LIST

| Part Number | Description |
|---|---|
| 141 | cradle |
| 142 | flat underside |
| 143 | concavity/concave portion |
| 144 | top arc/top sliding bar |
| 145 | air connector hole |
| 146 | connection |
| 147 | connection |
| 148 | air bladder |
| 149 | inflation hose |
| 150 | sleeve |
| 151 | open area |
| 160 | latch |
| 161 | interlocking portion on base or cradle 181 |
| 162 | interlocking portion on top arc 184 |
| 164 | joint/ball joint |
| 165 | joint/ball joint |
| 166 | slot/cavity |
| 167 | slot/cavity |
| 168 | arm |
| 169 | arm |
| 181 | cradle/base |
| 184 | top arc |
| 185 | pivot/pivotal connection |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A leg restraining apparatus for use in knee surgery and in combination with a surgical table upon which a patient is resting, comprising:

a) a restraining member removably attached to the table, the restraining member having a base member having a first end and a second end, wherein the second end has a pair of spaced apart, vertically extending flanges with a recess portion in between said flanges, each said flange having an upper end and said base member having a curved concave section that is positioned to cradle part of the patient's leg;

b) the restraining member including a curved arc member having a constant diameter and having open and closed positions, wherein the arc member includes a first end portion that is a free end, wherein the free end abuts a surface of the base member first end in the closed position, wherein the free end is removably connected to the base member via a latch;

c) the curved arc member including a second end portion that is a thickened section, wherein said second end portion is positioned in the recess portion in between said flanges and attached to the base member with a pivotal connection on said base that is below said flange upper ends, wherein the arc member is movable between said open and closed positions via said pivotal connection;

d) wherein said arc member first end portion is disconnected from the base member in the open position, and wherein the restraining member prevents substantial movement of the patient's leg when the curved arc member is in the closed position;

e) the restraining member having a connector that enables connection to the table;

f) the open position of the curved arc member enabling a surgeon to flex the patient's leg and knee, including elevating the patient's leg above the base; and g) wherein at least part of said thickened portion occupies said recess between said flanges in both said open and closed positions and the flanges extend above the thickened portion in the open position.

2. The leg restraining apparatus constructed in accordance with claim 1 further comprising an inflatable cuff attached to said restraining member.

3. The leg restraining apparatus constructed in accordance with claim 1 wherein the base is a cradle having an upwardly facing concavity that cradles the patient's leg from below.

4. The leg restraining apparatus constructed in accordance with claim 1 wherein the restraining member is of a polycarbonate material.

5. The leg restraining apparatus constructed in accordance with claim 4 wherein the restraining member is of a glass polycarbonate blend.

6. The leg restraining apparatus constructed in accordance with claim 4 wherein the restraining member is of in excess of 50% long strand glass and polycarbonate plastic material.

7. The leg restraining apparatus of claim 1 wherein the restraining member base member does not encircle the patient's leg.

8. The leg restraining apparatus of claim 1 wherein the pivotal connection includes a pin removably inserted through one of said base member flanges, into the second end portion of the curved arc member, and through the other of said base member flanges.

9. The leg restraining apparatus of claim 1, further comprising a latch on the first end of the base member for securing the free end of the curved arc member in the closed position.

10. The leg restraining apparatus of claim 1, wherein the curved arc member does not encircle the patient's leg.

11. A leg restraining apparatus for use in knee surgery and in combination with a surgical table upon which a patient is resting, comprising:

a) a restraining member removably attached to the table, the restraining member having a connecting portion that includes a flange and that attaches to the table, a cradle section having first and second end portions, and a concave portion that is positioned to cradle part of the patient's leg, wherein the second end portion includes a pair of spaced apart, vertically extending flanges having a recess in between said flanges, each said flange having a flange upper end;

b) the restraining member including a curved top arc having a constant diameter and having open and closed positions, wherein the arc includes a first end that is a free end that is detachable from said cradle section via interlocking surfaces of the free end and the cradle section, wherein the free end is secured to the cradle section with a locking mechanism;

c) the arc including a second end that is a thickened section and that is positioned in between said pair of spaced apart flanges and in the recess;

d) wherein the curved top arc second end is pivotally attached to the cradle at a pivotal connection that is below said flange upper ends;

e) wherein said arc rotates between said open and closed positions, wherein said arc first end is disconnected from the cradle section in the open position;

f) wherein the restraining member prevents substantial movement of the patient's leg when the curved arc member is in the closed position;

g) the open position of the curved top arc enabling a surgeon to flex the patient's leg and knee, including elevating the patient's leg above the cradle section; and h) wherein at least part of said thickened portion occupies said recess between said flanges in both said open and closed positions and the flanges extend above the thickened portion in the open position.

12. The leg restraining apparatus of claim 11, further comprising an inflatable cuff attached to said restraining member.

13. The leg restraining apparatus of claim 11, wherein the cradle section has an upwardly facing concavity that cradles the patient's leg from below.

14. The leg restraining apparatus of claim 11, wherein the restraining member is of a polycarbonate material.

15. The leg restraining apparatus of claim 14, wherein the restraining member is of a glass polycarbonate blend.

16. The leg restraining apparatus of claim 14, wherein the restraining member is of in excess of 50% long strand glass and polycarbonate plastic material.

17. The leg restraining apparatus of claim 11, wherein the cradle section does not encircle the patient's leg.

18. The leg restraining apparatus of claim 11, wherein the curved top arc is connected to the cradle section via a removable pin that is inserted through one of said flanges, into the second end portion of the curved top arc, and through the other of said flanges.

19. The leg restraining apparatus of claim 11, further comprising a latch on the cradle section first end for securing the curved top arc in the closed position.

20. The leg restraining apparatus of claim 11, wherein the curved top arc does not encircle the patient's leg.

* * * * *